US011705625B2

(12) United States Patent
Tezuka

(10) Patent No.: US 11,705,625 B2
(45) Date of Patent: Jul. 18, 2023

(54) ANTENNA DEVICE

(71) Applicant: TDK Corporation, Tokyo (JP)

(72) Inventor: Masao Tezuka, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 17/336,988

(22) Filed: Jun. 2, 2021

(65) Prior Publication Data

US 2021/0384619 A1 Dec. 9, 2021

(30) Foreign Application Priority Data

Jun. 4, 2020 (JP) ..... 2020-097712
Apr. 19, 2021 (JP) ..... 2021-070266

(51) Int. Cl.

| | |
|---|---|
| ***H01Q 1/38*** | (2006.01) |
| ***H01Q 1/48*** | (2006.01) |
| ***H01Q 1/22*** | (2006.01) |
| ***H01Q 9/04*** | (2006.01) |
| ***H01Q 13/10*** | (2006.01) |

(52) U.S. Cl.

CPC ..... *H01Q 1/38* (2013.01); *H01Q 1/2283* (2013.01); *H01Q 1/48* (2013.01); *H01Q 9/045* (2013.01); *H01Q 13/106* (2013.01)

(58) Field of Classification Search

CPC ..... H01Q 1/38; H01Q 1/2283; H01Q 1/48; H01Q 9/045; H01Q 13/106; H01Q 9/0457

See application file for complete search history.

(56) References Cited

U.S. PATENT DOCUMENTS

| | | | | |
|---|---|---|---|---|
| 2014/0070999 | A1 | 3/2014 | Kaneda et al. | |
| 2015/0340765 | A1* | 11/2015 | Dang | H01Q 1/2208 343/893 |
| 2016/0149300 | A1 | 5/2016 | Ito et al. | |
| 2019/0139913 | A1* | 5/2019 | Fang | H01Q 9/0414 |
| 2020/0076083 | A1 | 3/2020 | Fukunaga et al. | |
| 2020/0076087 | A1 | 3/2020 | Fukunaga et al. | |
| 2020/0106179 | A1 | 4/2020 | Izawa et al. | |
| 2020/0312798 | A1 | 10/2020 | Kawahata | |
| 2022/0158349 | A1 | 5/2022 | Onaka et al. | |

FOREIGN PATENT DOCUMENTS

| | | | |
|---|---|---|---|
| JP | 2005-184123 | A | 7/2005 |
| JP | 6159407 | B2 | 7/2017 |
| JP | 2020-036220 | A | 3/2020 |
| JP | 2020-036221 | A | 3/2020 |
| WO | 2005/081364 | A1 | 9/2005 |
| WO | 2018/116867 | A1 | 6/2018 |

* cited by examiner

*Primary Examiner* — David E Lotter
(74) *Attorney, Agent, or Firm* — McDermott Will & Emery LLP

(57) ABSTRACT

Disclosed herein is an antenna device that includes a first molded substrate having first and second surfaces opposite to each other, a second molded substrate having third and fourth surfaces opposite to each other, a first electrode formed on the first surface of the first molded substrate, a feed electrode formed on the second surface of the first molded substrate so as to overlap the first electrode in a plan view, and a first ground electrode formed on the third surface of the second molded substrate. The first and second molded substrates overlap each other such that the second surface of the first molded substrate and the fourth surface of the second molded substrate face each other.

20 Claims, 17 Drawing Sheets

2(3)

ANTENNA DEVICE

BACKGROUND

Field

The present disclosure relates to an antenna device.

Description of Related Art

Antenna devices for a high frequency band needs to use an insulating material having a low permittivity for a substrate. As the material having a low permittivity, fluororesins such as polytetrafluoroethylene are known. However, fluororesins are generally insufficient in rigidity and have a large thermal expansion coefficient, so that it is difficult to improve pattern accuracy. For example, an antenna device for a 300 GHz band requires pattern accuracy of a level of ±1 μm. To achieve such a level of accuracy is extremely difficult with the use of fluororesins as the material of the substrate.

As insulating materials small in thermal expansion coefficient and high in rigidity, although not lower in permittivity than fluororesins, melted and solidified materials such as glass and fired materials such as HTCC are exemplified. An example of an antenna device using glass as the material of the substrate is described in Japanese Patent No. 6,159,407.

However, when melted and solidified materials such as glass and fired materials such as HTCC are used as the material of the substrate, common lamination processes cannot be used for a resin printed circuit board and an LTCC ceramic substrate. Thus, when a radiation electrode, a feed electrode, and a ground electrode are provided on mutually different layers, it is necessary to overlap a plurality of molded substrates made of a melted and solidified material or a fired material.

Although not related to an antenna device using molded substrates made of a melted and solidified material or a fired material, JP 2020-036220A discloses in FIG. 2 thereof an antenna device having first and second substrates overlapping each other, the first surface having a ground electrode on one substrate and a feed electrode on the other surface thereof, the second substrate having a radiation electrode on one surface thereof. However, in this configuration, the distance between the radiation electrode and the feed electrode may change due to manufacturing variations. In particular, when this configuration is applied to an antenna device for a high frequency band of 300 GHz, stable characteristics are difficult to maintain.

Further, although not related to an antenna device using molded substrates made of a melted and solidified material or a fired material, WO 2018/116867 discloses a structure having a first substrate having a radiation electrode, a second substrate having a feed electrode, and a third substrate having an opening and interposed between the first and second substrates. However, also in this configuration, the distance between the radiation electrode and the feed electrode may change due to manufacturing variations.

SUMMARY

It is therefore an object of the present disclosure to suppress variations in characteristics due to manufacturing variations in an antenna device using a molded substrate made of a melted and solidified material such as glass or a fired material such as HTCC.

An antenna device according to an embodiment of the present disclosure includes: a first molded substrate having first and second surfaces opposite to each other, a second molded substrate having third and fourth surfaces opposite to each other, a first electrode formed on the first surface of the first molded substrate, a feed electrode formed on the second surface of the first molded substrate so as to overlap the first electrode in a plan view, and a first ground electrode formed on the third surface of the second molded substrate. The first and second molded substrates overlap each other such that the second surface of the first molded substrate and the fourth surface of the second molded substrate face each other.

Thus, according to the embodiment of the present disclosure, it is possible to suppress variations in characteristics due to manufacturing variations in an antenna device using a molded substrate made of a melted and solidified material such as glass or a fired material such as HTCC.

BRIEF DESCRIPTION OF THE DRAWINGS

The above features and advantages of the present disclosure will be more apparent from the following description of certain preferred embodiments taken in conjunction with the accompanying drawings, in which:

FIG. 2A is a plan view of the glass substrate 10 as viewed from a surface 11 side, FIG. 2B is a side view of the glass substrate 10, and FIG. 2C is a bottom view of the glass substrate 10 as viewed from a surface 12 side;

FIG. 3A is a plan view of the glass substrate 20 as viewed from a surface 22 side, FIG. 3B is a side view of the glass substrate 20, and FIG. 3C is a bottom view of the glass substrate 20 as viewed from a surface 21 side;

FIG. 5A is a plan view of the glass substrate 10 as viewed from the surface 11 side, FIG. 5B is a side view of the glass substrate 10, and FIG. 5C is a bottom view of the glass substrate 10 as viewed from the surface 12 side;

FIG. 6A is a plan view of the glass substrate 20 as viewed from the surface 22 side, FIG. 6B is a side view of the glass substrate 20, and FIG. 6C is a bottom view of the glass substrate 20 as viewed from the surface 21 side;

FIG. 7A is a plan view of the glass substrate 10 as viewed from the surface 11 side, FIG. 7B is a side view of the glass substrate 10, and FIG. 7C is a bottom view of the glass substrate 10 as viewed from the surface 12 side;

FIG. 10A is a plan view of the glass substrate 20 as viewed from the surface 22 side, FIG. 10B is a side view of the glass substrate 20, and FIG. 10C is a bottom view of the glass substrate 20 as viewed from the surface 21 side;

DETAILED DESCRIPTION OF THE EMBODIMENTS

Preferred embodiments of the present disclosure will be explained below in detail with reference to the accompanying drawings.

First Embodiment

Figure 1:
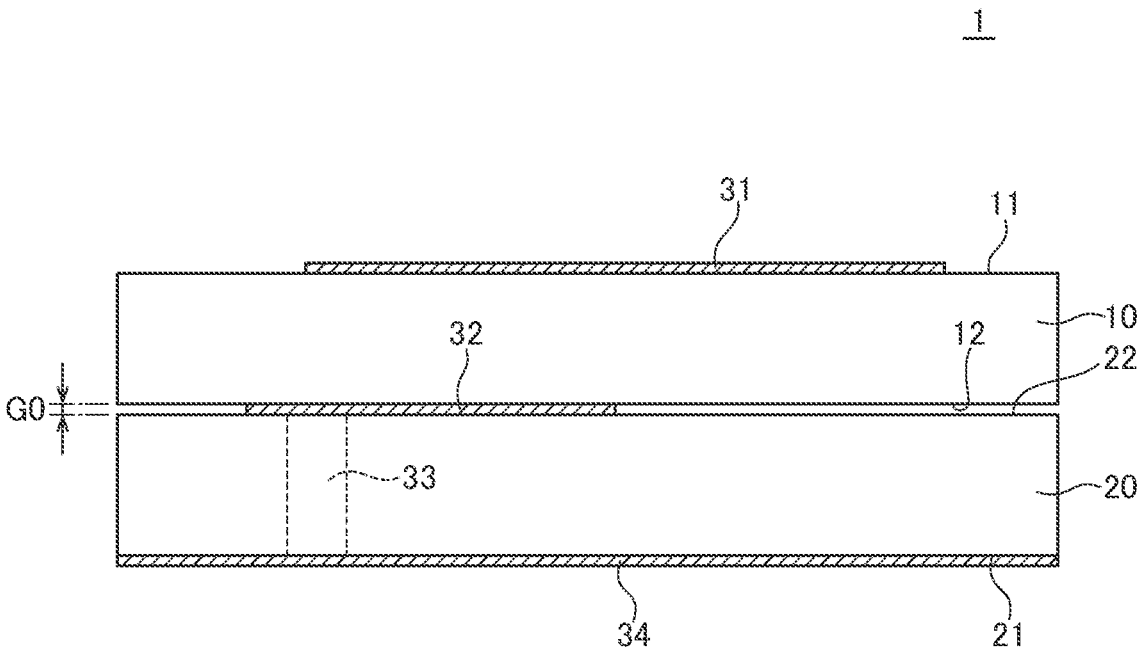
FIG. 1 is a side view for explaining the structure of an antenna device 1 according to a first embodiment of the present disclosure.

FIG. 1 is a side view for explaining the structure of an antenna device 1 according to a first embodiment of the present disclosure.

As illustrated in FIG. 1, the antenna device 1 according to the first embodiment has a configuration in which two glass substrates 10 and 20, each as a molded substrate, overlap each other. As the material of the glass substrates 10 and 20, a low permittivity glass material having a relative permittivity lower than that of a commonly used substrate material such as resin and preferably having a relative permittivity of less than 4 is used. In the present embodiment, glass is used as the material of the molded substrate, but not limited to this, and may be other melted and solidified materials and fired materials such as HTCC mainly composed of alumina ($Al_2O_3$).

Figure 2A:
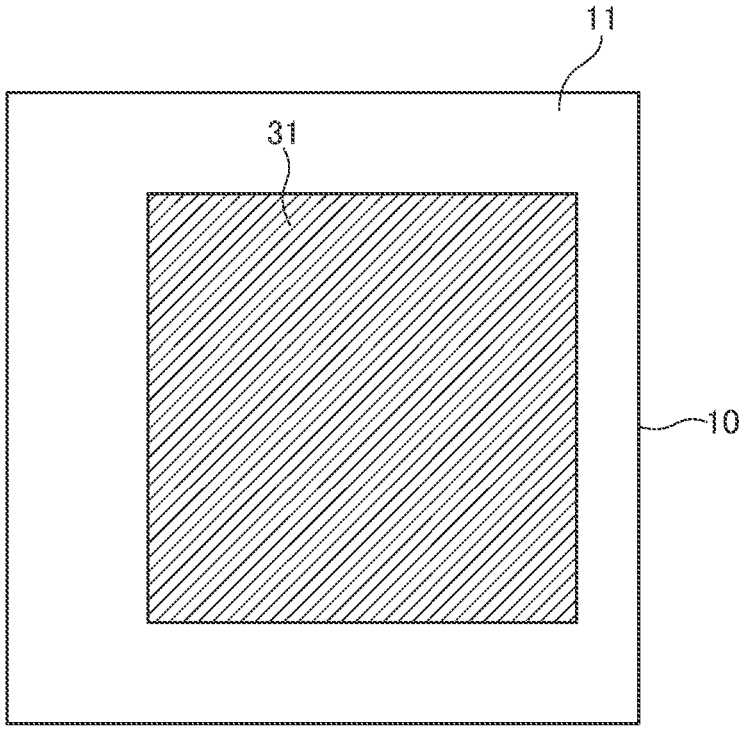
FIGS. 2A to 2C are views illustrating the structure of the glass substrate 10 used for the antenna device 1 according to the first embodiment of the present disclosure, where
Figure 2B:
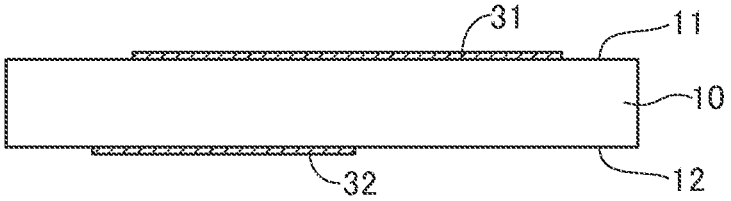
Figure 2C:
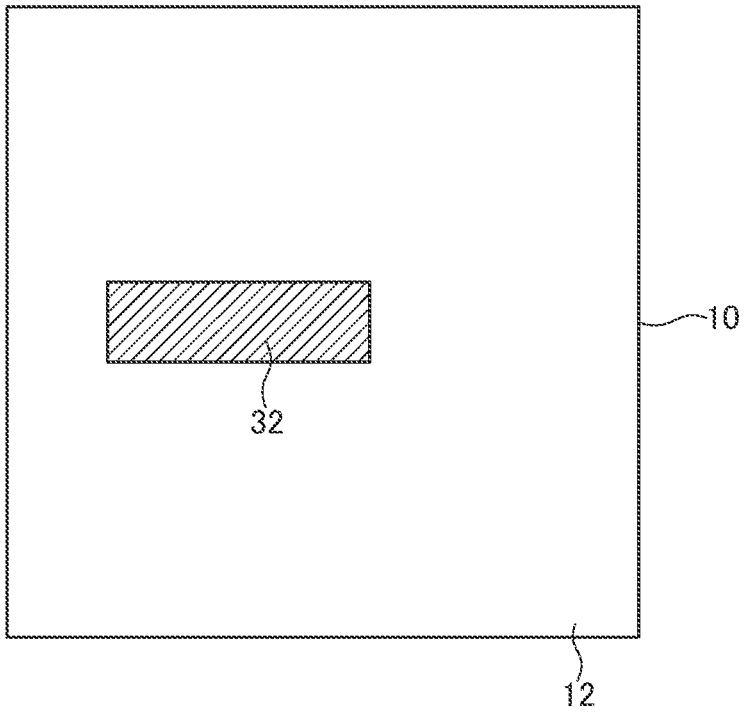
Figure 3A:
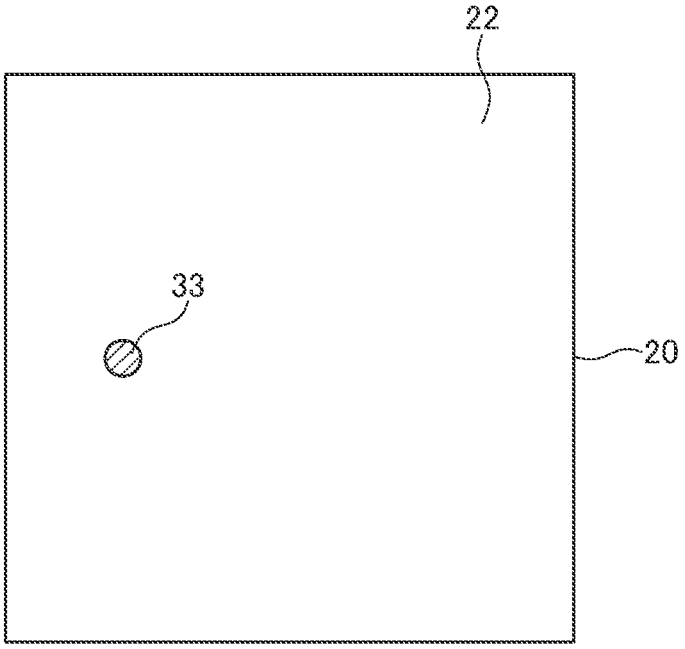
FIGS. 3A to 3C are views illustrating the structure of the glass substrate 20 used for the antenna device 1 according to the first embodiment of the present disclosure, where
Figure 3B:
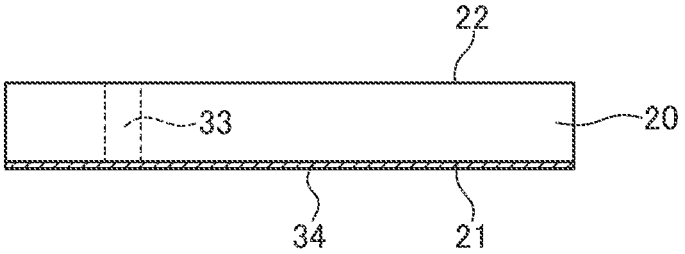
Figure 3C:
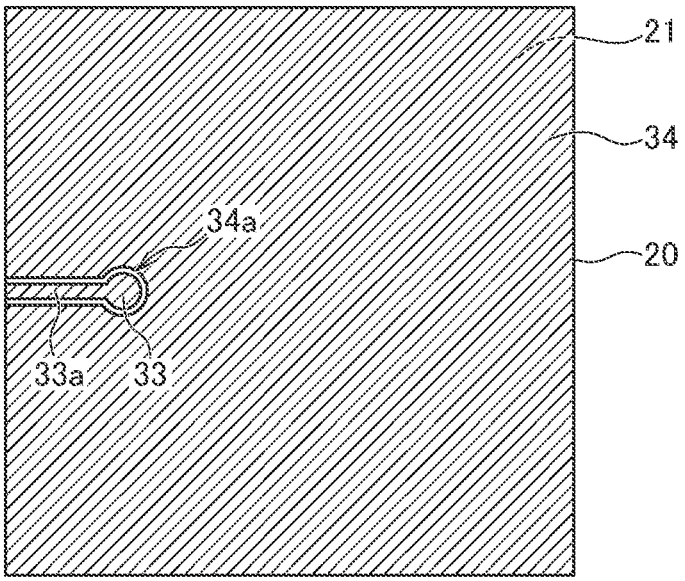

The configurations of the glass substrates 10 and 20 are illustrated in FIGS. 2A to 2C and 3A to 3C, respectively. FIG. 2A is a plan view of the glass substrate 10 as viewed from a surface 11 side, FIG. 2B is a side view of the glass substrate 10, and FIG. 2C is a bottom view of the glass substrate 10 as viewed from a surface 12 side. FIG. 3A is a plan view of the glass substrate 20 as viewed from a surface 22 side, FIG. 3B is a side view of the glass substrate 20, and FIG. 3C is a bottom view of the glass substrate 20 as viewed from a surface 21 side.

As illustrated in FIGS. 1 to 3, the glass substrate 10 has a radiation electrode 31 on the first surface 11 and a feed electrode 32 on the second surface 12. The radiation electrode 31 constitutes a first electrode for radiating an antenna signal. The feed electrode 32 is disposed at a position overlapping one side of the radiation electrode 31 in a plan view. As illustrated in FIGS. 1 and 3A to 3C, the glass substrate 20 has a ground electrode 34 (first ground electrode) on the third surface 21. The ground electrode 34 is formed on substantially the entire surface of the surface 21 of the glass substrate 20 except a cut part 34*a*. The glass substrate 20 further has a through conductor 33 penetrating therethrough from the third surface 21 to the fourth surface 22. A part of the through conductor 33 that is exposed to the surface 21 is located at a position corresponding to the cut part 34*a*, whereby the through conductor 33 is insulated from the ground electrode 34 and drawn to the edge portion of the glass substrate 20 through a extraction part 33*a*.

The glass substrates 10 and 20 overlap each other with the surface 12 of the glass substrate 10 and the surface 22 of the glass substrate 20 facing each other so as to connect the through conductor 33 and the feed electrode 32 to each other. This allows an antenna signal of a frequency f input through the extraction part 33*a* to be fed to the feed electrode 32 through the through conductor 33. Since the feed electrode 32 is disposed at a position overlapping one surface of the radiation electrode 31 in a plan view, the antenna signal is fed to the radiation electrode 31 by capacitive coupling. The frequency f of the antenna signal and a wavelength λ in vacuum have the following relation:

$$\lambda = f/c$$

where "c" is the speed of light ($2.99792458\times10^8$ m/s) in vacuum. Accordingly, when the frequency f of the antenna signal is 285 GHz, the wavelength λ in vacuum is 1050 μm.

A gap G0 corresponding to the thickness of the feed electrode 32 is formed between the surface 12 of the glass substrate 10 and the surface 22 of the glass substrate 20. The glass substrates 10 and 20 may be bonded to each other by a resin material filled in the gap G0.

The antenna device 1 according to the present embodiment uses glass as the material of the substrate. Thus, unlike a case where a resin material or an LTCC material is used as the material of the substrate, the substrate has been cured at the time of formation of conductor patterns such as the radiation electrode 31. Therefore, common lamination processes in which an uncured insulating material and a conductor pattern are alternately formed cannot be employed. Thus, in the antenna device 1 according to the present embodiment, the conductor patterns are formed so as to be disposed on the front and back surfaces of each of the two glass substrates 10 and 20 by overlapping the substrates 10 and 20. This allows a configuration requiring three or more conductor layers to be achieved using the glass substrates 10 and 20.

Further, glass is small in thermal expansion coefficient and high in rigidity, allowing pattern accuracy to be improved. In addition, the radiation electrode 31 and the feed electrode 32 are formed respectively on the front and back surfaces of the glass substrate 10, preventing the distance between the radiation electrode 31 and the feed electrode 32 from changing due to manufacturing variations. Thus, it is possible to achieve designed characteristics even in a high frequency band with a resonance frequency of 300 GHz.

Second Embodiment

Figure 4:
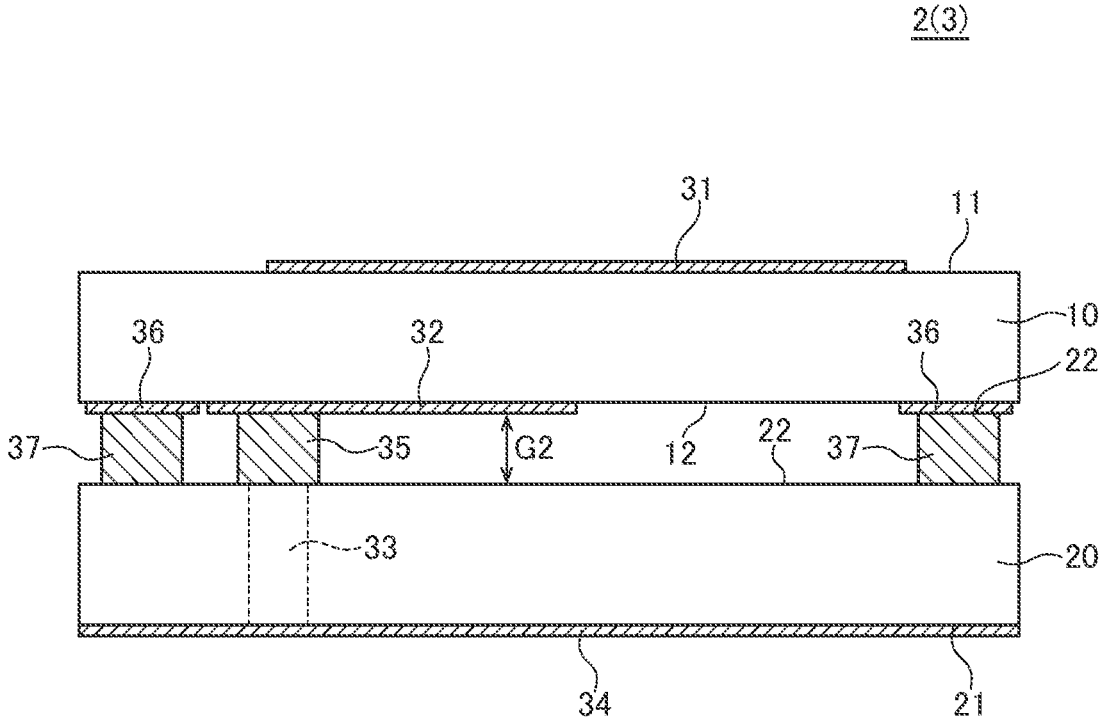
FIG. 4 is a side view for explaining the structure of an antenna device 2 according to a second embodiment of the present disclosure.
Figure 5A:
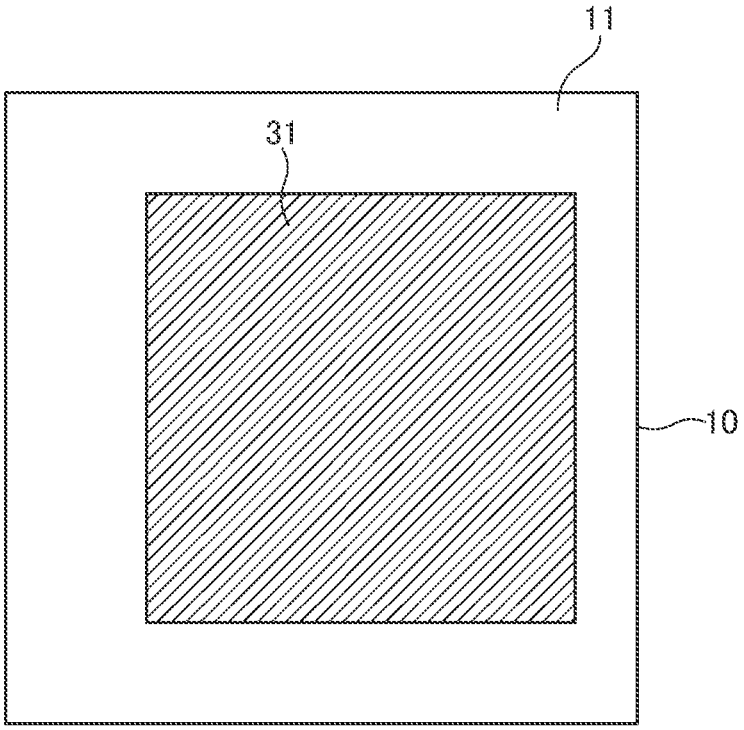
FIGS. 5A to 5C are views illustrating the structure of the glass substrate 10 used for the antenna device 2 according to the second embodiment of the present disclosure, where
Figure 5B:
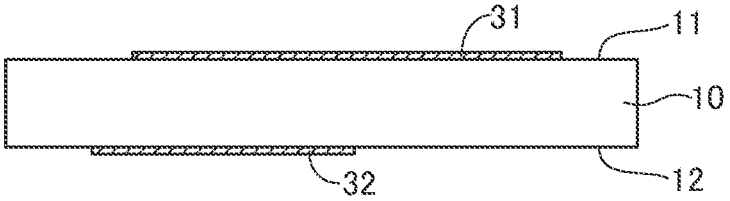
Figure 5C:
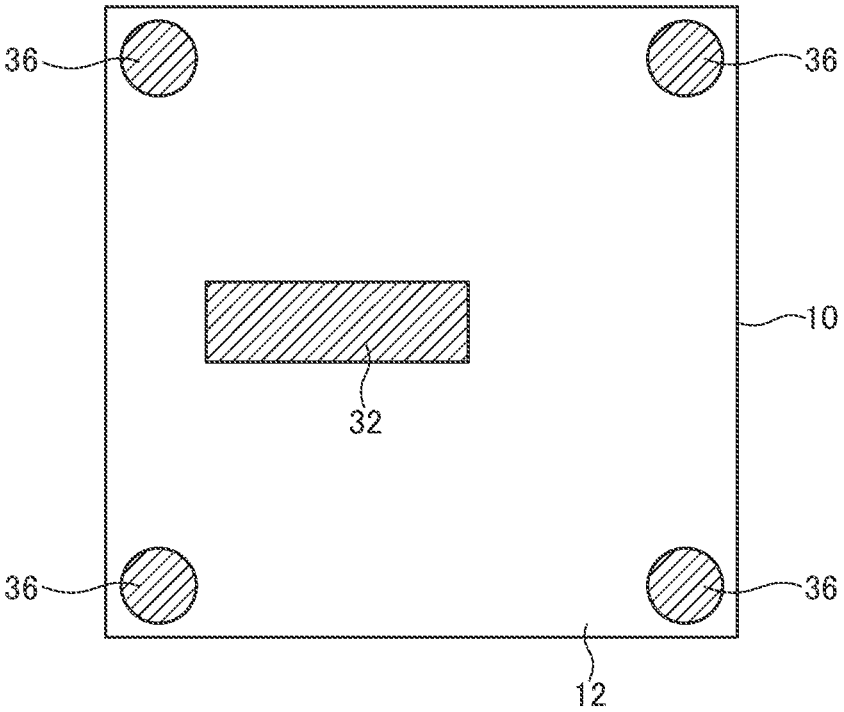
Figure 6A:
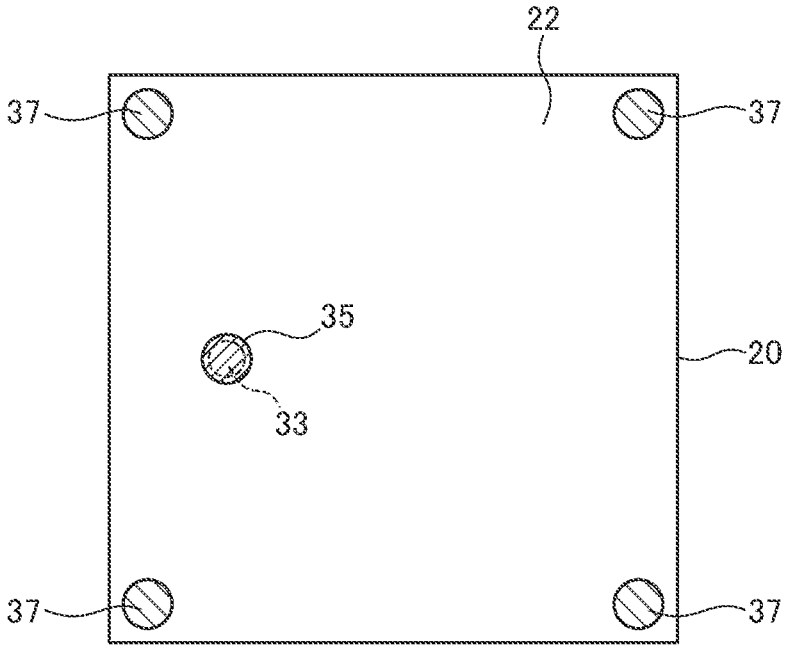
FIGS. 6A to 6C are views illustrating the structure of the glass substrate 20 used for the antenna device 2 according to the second embodiment of the present disclosure, where
Figure 6B:
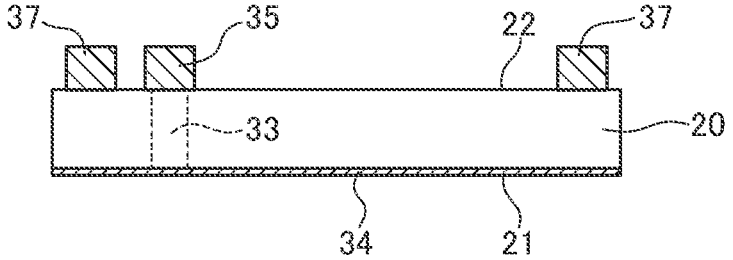
Figure 6C:
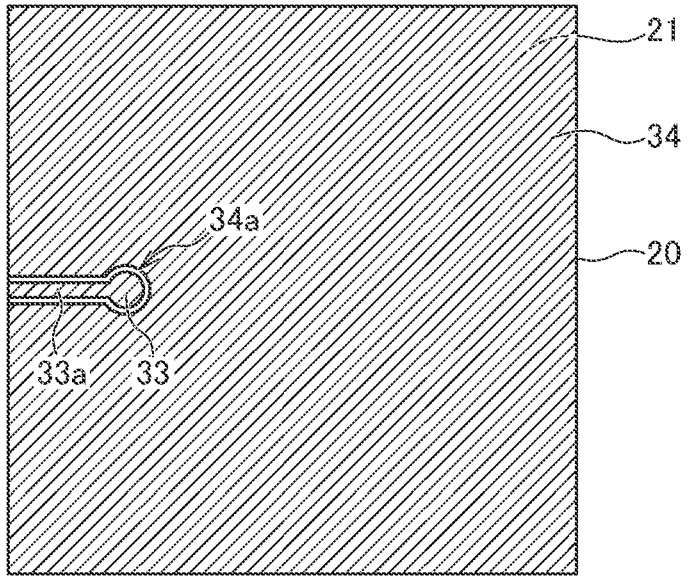

FIG. 4 is a side view for explaining the structure of an antenna device 2 according to a second embodiment of the present disclosure. FIGS. 5A to 5C are views illustrating the structure of the glass substrate 10 used for the antenna device 2 according to the second embodiment. FIG. 5A is a plan view of the glass substrate 10 as viewed from the surface 11 side, FIG. 5B is a side view of the glass substrate 10, and FIG. 5C is a bottom view of the glass substrate 10 as viewed from the surface 12 side. FIGS. 6A to 6C are view illustrating the structure of the glass substrate 20 used for the antenna device 2 according to the second embodiment. FIG. 6A is a plan view of the glass substrate 20 as viewed from the surface 22 side, FIG. 6B is a side view of the glass substrate 20, and FIG. 6C is a bottom view of the glass substrate 20 as viewed from the surface 21 side.

As illustrated in FIGS. 4 through 6C, the antenna device 2 according to the second embodiment differs from the antenna device 1 according to the first embodiment in that the glass substrate 10 further has conductor patterns 36 on the surface 12 and that the glass substrate 20 has bump electrodes 35 and 37 on the surface 22. Other configurations are the same as those of the antenna device 1 according to the first embodiment, so the same reference numerals are given to the same elements, and overlapping description will be omitted.

The bump electrode 35 is connected to the end portion of the through conductor 33 exposed to the surface 22 of the glass substrate 20 and has a predetermined height dimension. In the present embodiment, the feed electrode 32 and the through conductor 33 are connected to each other through the bump electrode 35. Accordingly, a gap G2 defined by the height of the bump electrode 35 is formed between the feed electrode 32 and the surface 22 of the glass substrate 20.

In a state where the glass substrates 10 and 20 overlap each other, a plurality of the conductor patterns 36 and a plurality of the bump electrodes 37 are connected one-to-one to thereby hold the glass substrates 10 and 20 parallel. That is, the conductor patterns 36 and bump electrodes 37 function as spacers for holding the glass substrates 10 and 20 in parallel. In the example illustrated in FIGS. 5A to 6C, the conductor patterns 36 and bump electrodes 37 are provided around the corners of the respective glass substrates 10 and 20 in a plan view; however, the positions and the number of the conductor patterns 36 and bump electrodes 37 are not particularly limited. Further, as the spacer for holding the glass substrates 10 and 20 parallel, a conductor like the conductor pattern 36 and bump electrode 37 may not necessarily be used, but a member made of an insulating material and a member integrated with the molded substrate may be used.

According to the present embodiment, the gap G2 between the feed electrode 32 and the surface 22 of the glass substrate 20 can be adjusted by the height of the bump electrode 35 or the height of the spacer. In the present embodiment, the gap G2 is provided with no other members but is filled with air. The width of the gap G2 has influence on antenna characteristics. Specifically, when the resonance frequency is in a 300 GHz band, it shifts to a high frequency side by the presence of the gap G2. Further, setting the width of the gap G2 to about 10 μm improves reflection characteristics as compared to when the gap G2 is absent.

Third Embodiment

Figure 7A:
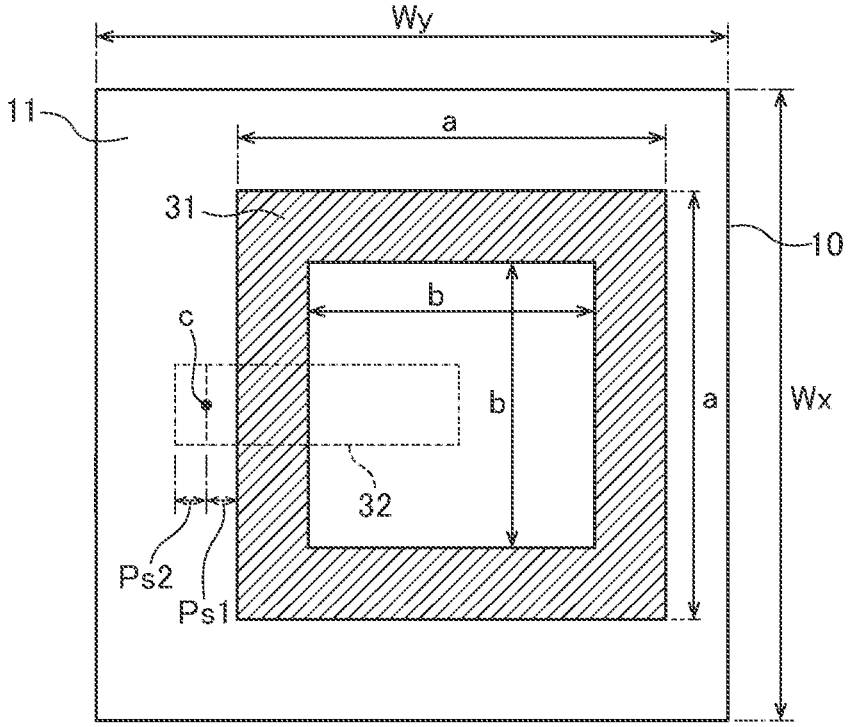
FIGS. 7A to 7C are views illustrating the structure of the glass substrate 10 used for an antenna device 3 according to a third embodiment of the present disclosure, where
Figure 7B:
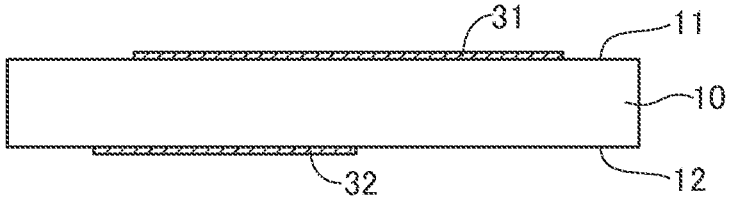
Figure 7C:
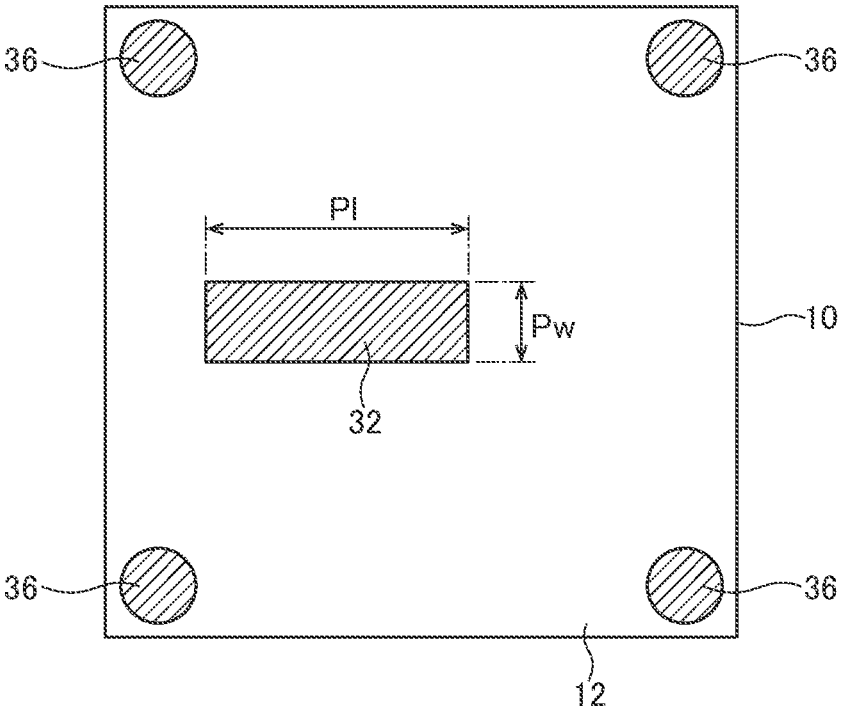

FIGS. 7A to 7C are views illustrating the structure of the glass substrate 10 used for an antenna device 3 according to a third embodiment of the present disclosure. FIG. 7A is a plan view of the glass substrate 10 as viewed from the surface 11 side, FIG. 7B is a side view of the glass substrate 10, and FIG. 7C is a bottom view of the glass substrate 10 as viewed from the surface 12 side. The side view of the antenna device 3 is illustrated in FIG. 4.

The glass substrate 10 illustrated in FIGS. 7A to 7C differs from the glass substrate 10 of the antenna device 2 according to the second embodiment in that the radiation electrode 31 formed on the surface 11 has an annular shape. Other configurations are the same as those of the antenna device 2 according to the second embodiment, so the same reference numerals are given to the same elements, and overlapping description will be omitted.

As exemplified in the present embodiment, the radiation electrode 31 may not necessarily have a solid pattern but may have an annular shape.

Fourth Embodiment

Figure 8:
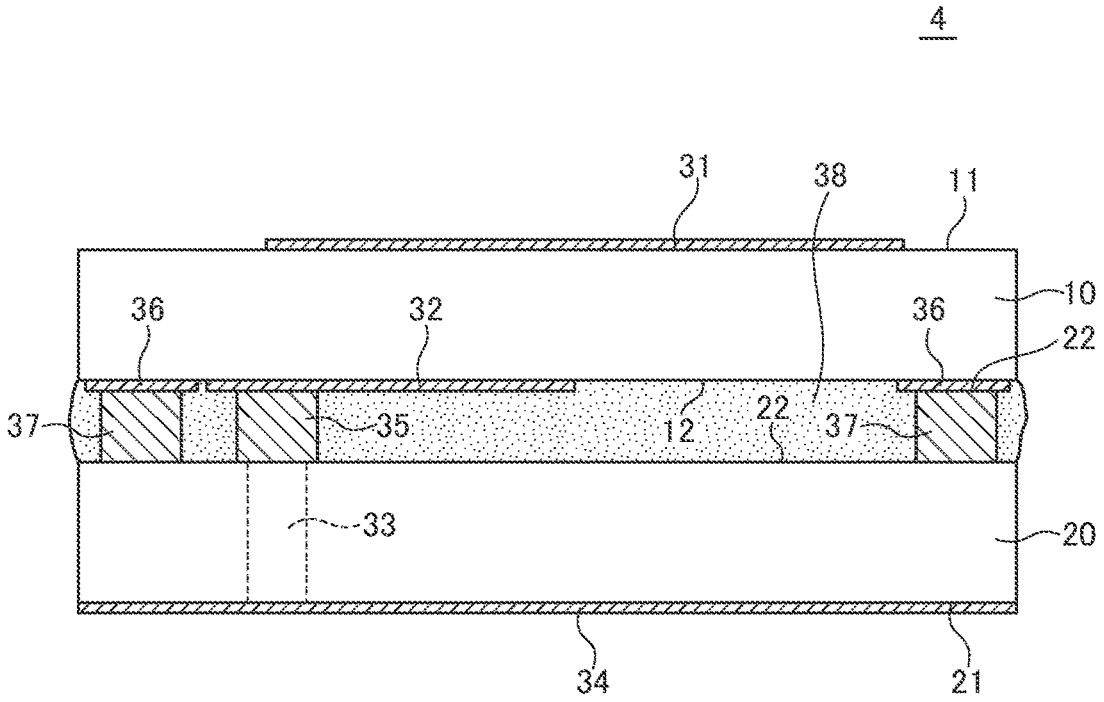
FIG. 8 is a side view for explaining the structure of an antenna device 4 according to a fourth embodiment of the present disclosure.

FIG. 8 is a side view for explaining the structure of an antenna device 4 according to a fourth embodiment of the present disclosure.

As illustrated in FIG. 8, the antenna device 4 according to the fourth embodiment differs from the antenna device 3 according to the third embodiment in that a resin material 38 is provided between the surface 12 of the glass substrate 10 and the surface 22 of the glass substrate 20. Other configurations are the same as those of the antenna device 3 according to the third embodiment, so the same reference numerals are given to the same elements, and overlapping description will be omitted.

The resin material 38 bonds the glass substrates 10 and 20 and is also provided inside the gap G2. As exemplified in the present embodiment, the gap G2 may not necessarily be filled with air but may at least partially be filled with the resin material 38. When the gap G2 is filled with the resin material 38, the relation between the size of the gap G2 and a relative permittivity ε of the resin material 38 preferably satisfies $G2<0.06\ (\lambda/\sqrt{\varepsilon})$. This achieves a radiation bandwidth over which the antenna device can perform its function properly.

Fifth Embodiment

Figure 9:
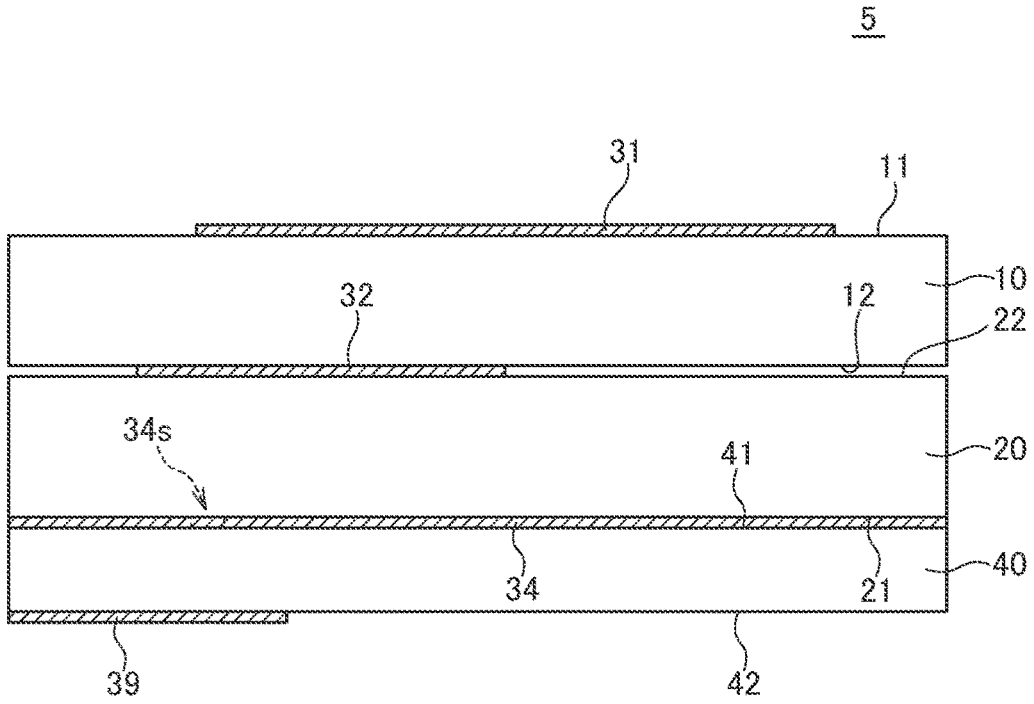
FIG. 9 is a side view for explaining the structure of an antenna device 5 according to a fifth embodiment of the present disclosure.

FIG. 9 is a side view for explaining the structure of an antenna device 5 according to a fifth embodiment of the present disclosure.

As illustrated in FIG. 9, the antenna device 5 according to the fifth embodiment differs from the antenna device 1 according to the first embodiment in that it further includes a dielectric layer 40 formed on the surface 21 of the glass substrate 20, a extraction conductor 39 formed on a fifth surface 42 of the dielectric layer 40, and a slot 34*s* in the ground electrode 34 in place of the through conductor 33. Other configurations are the same as those of the antenna device 1 according to the first embodiment, so the same reference numerals are given to the same elements, and overlapping description will be omitted.

Figure 10A:
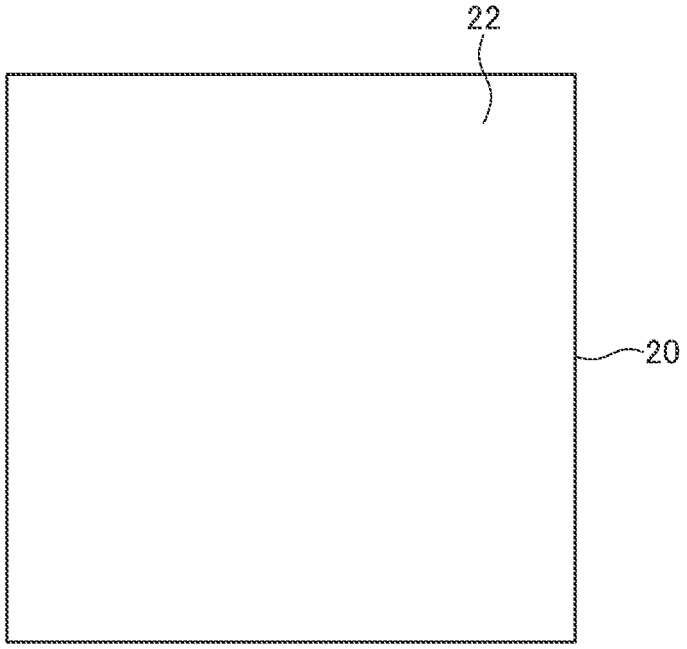
FIGS. 10A to 10C are views illustrating the structure of the glass substrate 20 used for the antenna device 5 according to the fifth embodiment of the present disclosure, where
Figure 10B:
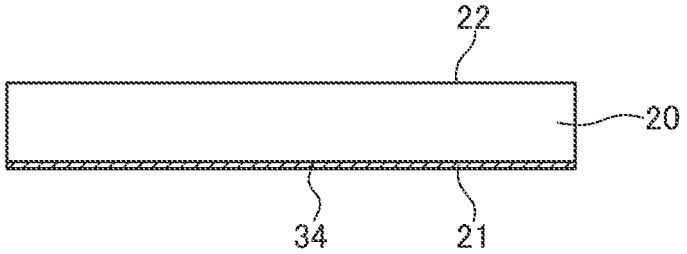
Figure 10C:
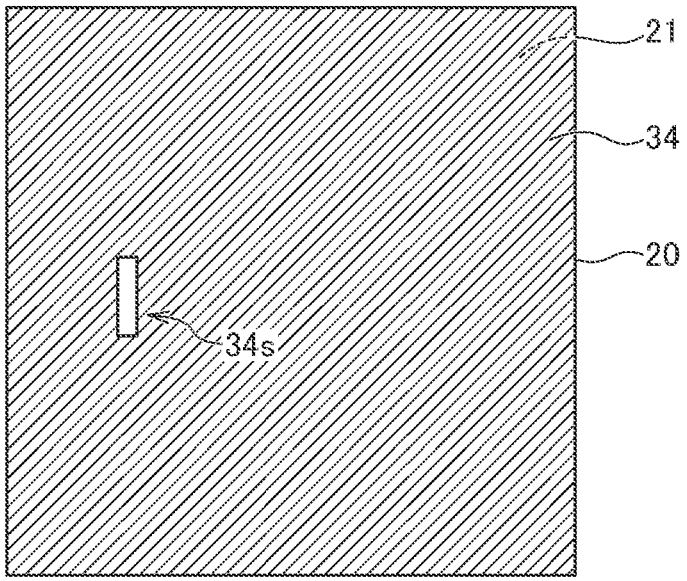
Figure 11:
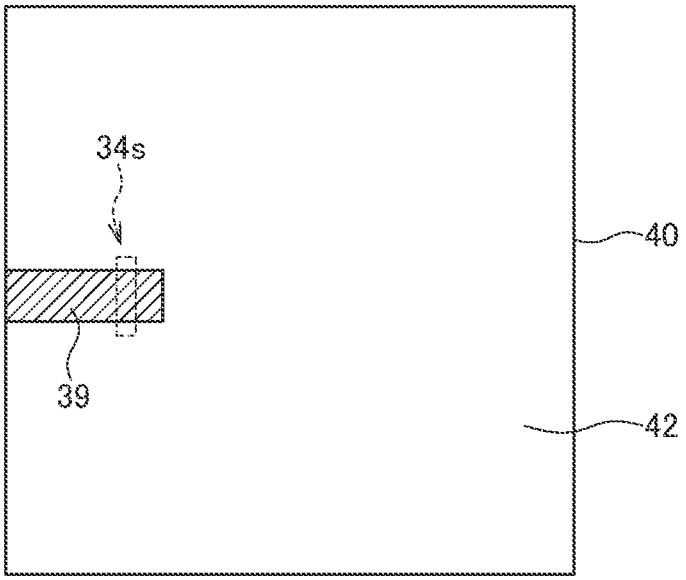
FIG. 11 is a bottom view of the dielectric layer 40 as viewed from the surface 42 side.

FIGS. 10A to 10C are views illustrating the structure of the glass substrate 20 used for the antenna device 5 according to the fifth embodiment. FIG. 10A is a plan view of the glass substrate 20 as viewed from the surface 22 side, FIG. 10B is a side view of the glass substrate 20, and FIG. 10C is a bottom view of the glass substrate 20 as viewed from the surface 21 side. FIG. 11 is a bottom view of the dielectric layer 40 as viewed from the surface 42 side. The surface 42 of the dielectric layer 40 is the surface facing away from the sixth surface 41 that faces the glass substrate 20.

As illustrated in FIGS. 10A to 11, the extraction conductor 39 overlaps the slot 34*s* formed in the ground electrode 34. Thus, the extraction conductor 39 is electromagnetically coupled to the feed electrode 32 through the slot 34*s*. This allows an antenna signal of a frequency f input through the extraction conductor 39 to be fed to the feed electrode 32 through the slot 34*s*. Another ground electrode is not provided on one side of the extraction conductor 39 opposite to the other side thereof at which the ground electrode 34 is provided, so that the extraction conductor 39 constitutes a microstrip line.

As exemplified in the present embodiment, power may be fed to the feed electrode 32 not only through the through conductor 33 but also by electromagnetic coupling between the extraction conductor 39 and the feed electrode 32 through the slot 34*s*. Further, resin may be used as the material of the dielectric layer 40, allowing the dielectric layer 40 and extraction conductor 39 to be formed by common lamination processes.

Sixth Embodiment

Figure 12:
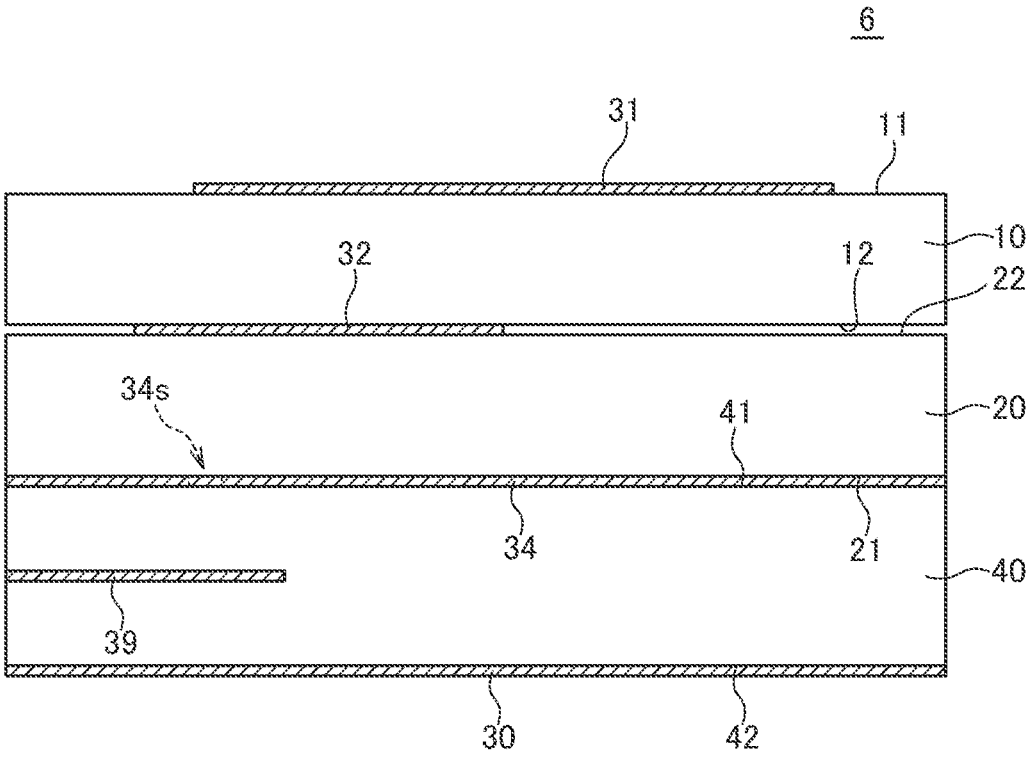
FIG. 12 is a side view for explaining the structure of an antenna device 6 according to a sixth embodiment of the present disclosure.

FIG. 12 is a side view for explaining the structure of an antenna device 6 according to a sixth embodiment of the present disclosure.

As illustrated in FIG. 12, the antenna device 6 according to the six embodiment differs from the antenna device 5 according to the fifth embodiment in that the dielectric layer 40 has a ground electrode 30 (second ground electrode) on the surface 42 and that the extraction conductor 39 is formed inside the dielectric layer 40. Other configurations are the same as those of the antenna device 5 according to the fifth embodiment, so the same reference numerals are given to the same elements, and overlapping description will be omitted In the present embodiment, the extraction conductor 39 is covered with the ground electrodes 34 and 30 from above and below, so that the extraction conductor 39 constitutes a strip line.

Seventh Embodiment

Figure 13:
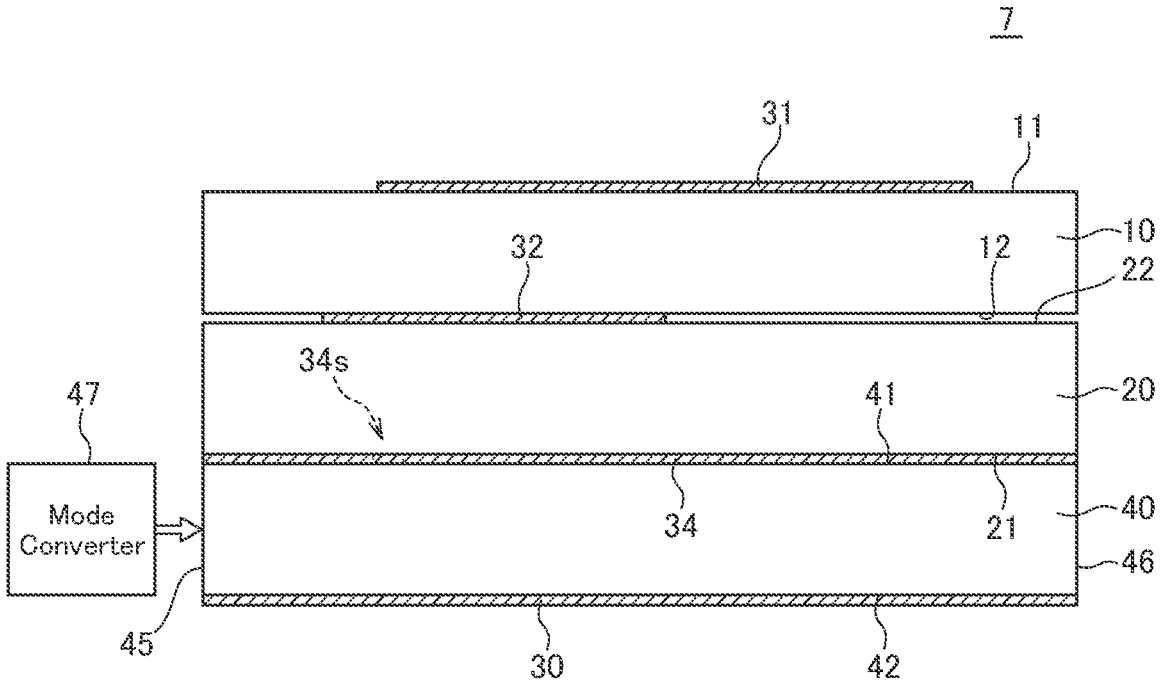
FIGS. 13 and 14 are side views for explaining the structure of an antenna device 7 according to a seventh embodiment of the present disclosure as viewed in directions different by 90°.
Figure 14:
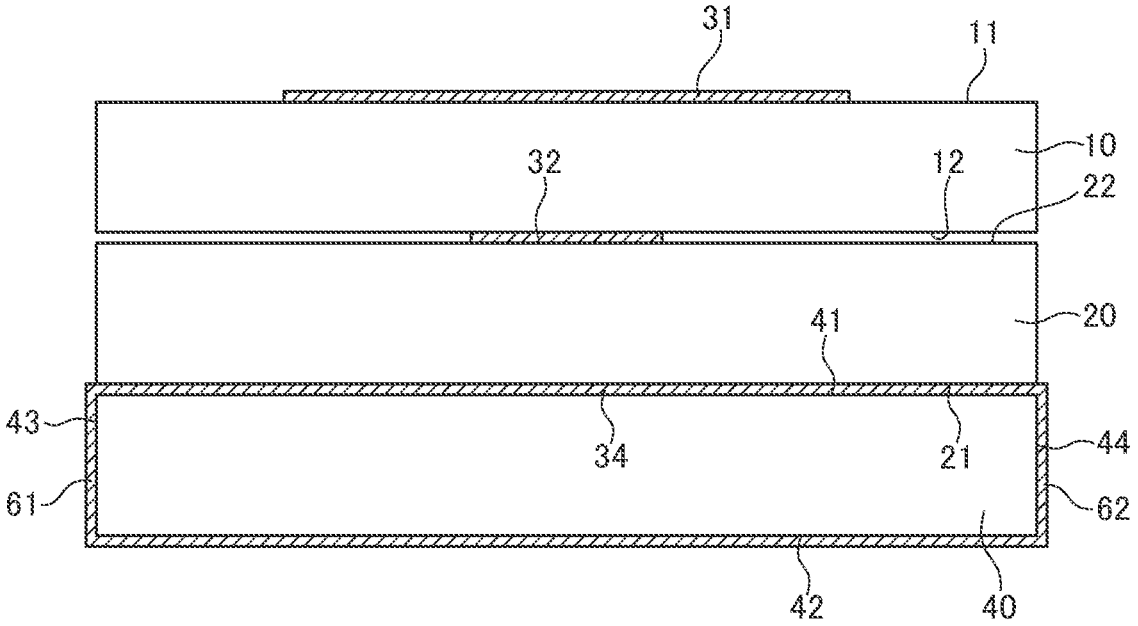

FIGS. 13 and 14 are side views for explaining the structure of an antenna device 7 according to a seventh embodiment of the present disclosure as viewed in directions different by 90°.

As illustrated in FIGS. 13 and 14, the antenna device 7 according to the seventh embodiment differs from the antenna device 6 according to the sixth embodiment in that the extraction conductor 39 is not provided inside the dielectric layer 40 and that side surfaces 43 and 44 of the dielectric layer 40 are covered with ground electrodes 61 and 62, respectively. Other configurations are the same as those of the antenna device 6 according to the sixth embodiment, so the same reference numerals are given to the same elements, and overlapping description will be omitted.

The side surfaces 43 and 44 of the dielectric layer 40 are perpendicular to the surface 42 of the dielectric layer 40 and constitute first and second mutually parallel side surfaces. Mutually parallel side surfaces 45 and 46 of the dielectric layer 40 are perpendicular to the side surfaces 43 and 44 and are covered with no ground electrode. The ground electrodes 61 and 62 constitute third and fourth ground electrodes, respectively. This allows the interior of the dielectric layer 40 surrounded by the ground electrodes 30, 34, 61, and 62 to function as a waveguide. The waveguide can be supplied with an antenna signal by means of a mode converter 47. When an antenna signal of a frequency f is input to the waveguide, it is fed to the feed electrode 32 through the slot 34*s*. As exemplified in the present embodiment, the waveguide and the feed electrode 32 may be electromagnetically coupled together through the slot 34*s*.

Eighth Embodiment

Figure 15:
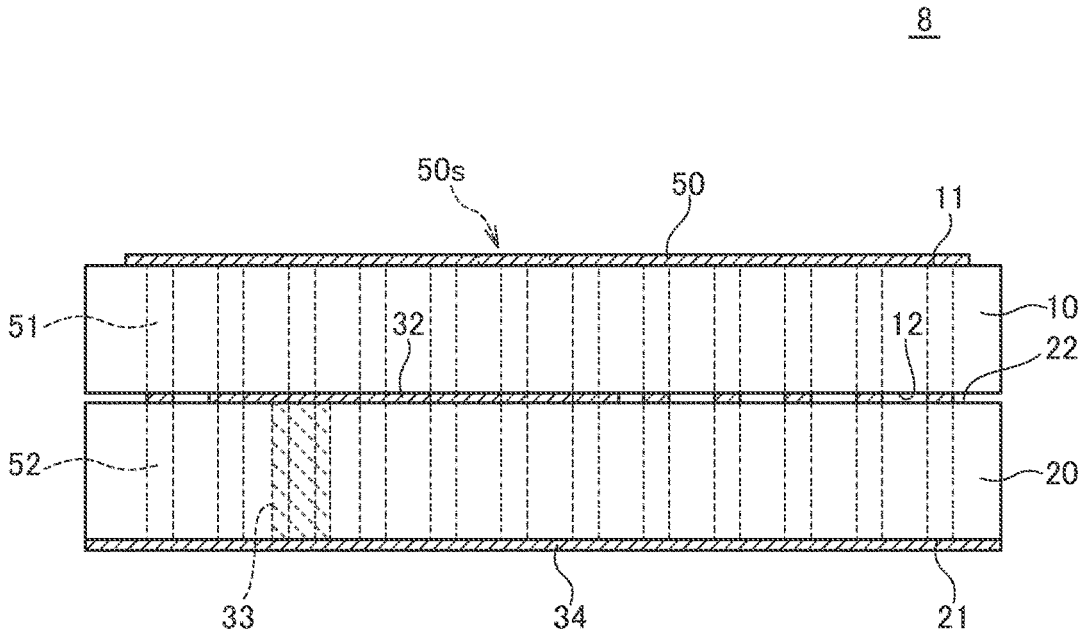
FIG. 15 is a side view for explaining the structure of an antenna device 8 according to an eighth embodiment of the present disclosure.

FIG. 15 is a side view for explaining the structure of an antenna device 8 according to an eighth embodiment of the present disclosure.

As illustrated in FIG. 15, the antenna device 8 according to the eighth embodiment differs from the antenna device 1 according to the first embodiment in that it has, in place of the radiation electrode 31, a first electrode 50 having a slot 50*s* and that the first electrode 50 and the ground electrode 34 are connected to each other through a plurality of through conductors 51 and a plurality of through conductors 52. Other configurations are the same as those of the antenna device 1 according to the first embodiment, so the same reference numerals are given to the same elements, and overlapping description will be omitted.

The through conductors 51 are first through conductors arranged along the peripheral edge of the first electrode 50 and connected to the first electrode 50 at their one ends. The through conductors 52 are second through conductors arranged along the peripheral edge of the ground electrode 34 and connected to the ground electrode 34 at their one ends. The glass substrates 10 and 20 overlap each other such that the other ends of the through conductors 51 and the other ends of the through conductors 52 are respectively connected. The glass substrate 20 has the through conductor 33 penetrating therethrough from the surface 21 to the surface 22. The pattern shape of the ground electrode 34 is the same as that illustrated in FIG. 3C, and a part of the through conductor 33 that is exposed to the surface 21 is drawn to the edge portion of the glass substrate 20 through the extraction part 33*a*. Alternatively, in place of providing the through conductor 33 and extraction part 33*a*, the feed electrode 32 may be extended to the edge portion of the glass substrate 20 in such a manner not to interfere with the through conductors 51 and 52 so as to allow an antenna signal to be directly input to the feed electrode 32.

Figure 16:
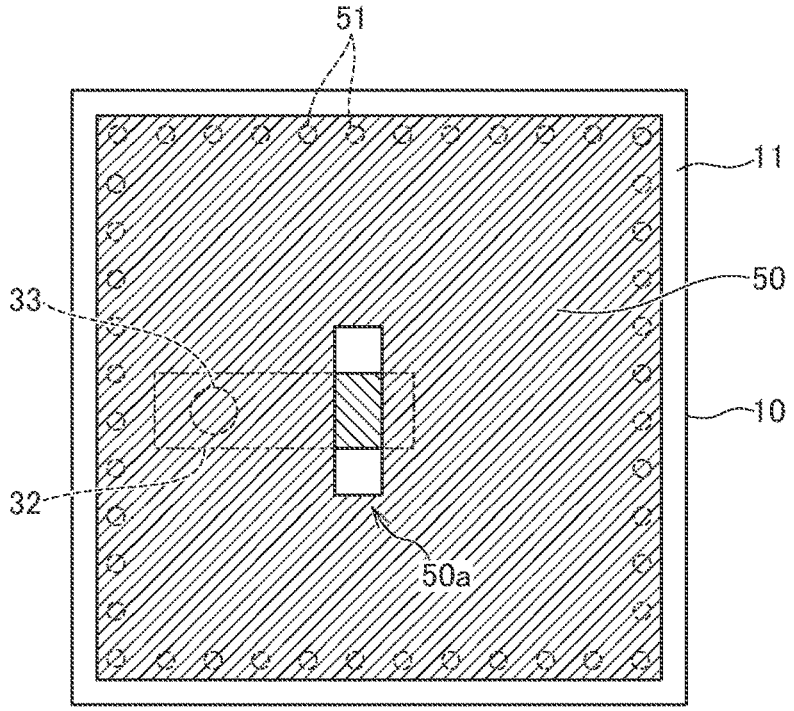
FIG. 16 is a plan view of the glass substrate 10 as viewed from the surface 11 side.

FIG. 16 is a plan view of the glass substrate 10 as viewed from the surface 11 side. As illustrated in FIG. 16, the slot 50*s* formed in the first electrode 50 overlaps the feed electrode 32 in a plan view. With this configuration, the antenna device 8 according to the present embodiment constitutes a slot antenna.

It is apparent that the present disclosure is not limited to the above embodiments, but may be modified and changed without departing from the scope and spirit of the disclosure.

The technology according to the present disclosure includes the following configuration examples, but not limited thereto.

An antenna device according to an embodiment of the present disclosure includes: a first molded substrate having first and second surfaces opposite to each other, a second molded substrate having third and fourth surfaces opposite to each other, a first electrode formed on the first surface of the first molded substrate, a feed electrode formed on the second surface of the first molded substrate so as to overlap the first electrode in a plan view, and a first ground electrode formed on the third surface of the second molded substrate. The first and second molded substrates overlap each other such that the second surface of the first molded substrate and the fourth surface of the second molded substrate face each other.

Thus, the first electrode and the feed electrode are formed respectively on the front and back surfaces of the first molded substrate in an antenna device using a molded substrate made of a melted and solidified material such as glass or a fired material such as HTCC, preventing the distance between the first electrode and the feed electrode from changing due to manufacturing variations. That is, in an antenna device using a molded substrate made of a melted and solidified material such as glass or a fired material such as HTCC, it is possible to suppress variations in characteristics due to manufacturing variations.

The antenna device according to the present disclosure may further have a through conductor formed to penetrate the second molded substrate, and the first and second molded substrates may overlap each other such that the through conductor and the feed electrode are connected to each other. This allows power to be fed to the feed electrode through the through conductor.

The antenna device according to the present disclosure may further have a bump electrode provided at the end portion of the through conductor exposed to the fourth surface of the second molded substrate, the through conductor and the feed electrode may be connected to each other through the bump electrode, and a gap defined by the height dimension of the bump electrode may be formed between the feed electrode and the fourth surface of the second molded substrate. This allows characteristics to be adjusted in accordance with the width of the gap.

The antenna device according to the present disclosure may further have a spacer for maintaining the gap provided between the second surface of the first molded substrate and the fourth surface of the second molded substrate. This can prevent a variation in the gap size. Further, the gap may be filled with a resin material. This can improve adhesion between the first and second molded substrates. In this case, assuming that the height dimension of the gap is G2, the relative permittivity of the resin material is $\varepsilon$, and the wavelength of an antenna signal to be fed to the first electrode in vacuum is $\lambda$, $G2<0.06\ (\lambda/\sqrt{\varepsilon})$ is preferably satisfied. This achieves a radiation bandwidth over which the antenna device can perform its function properly.

The antenna device according to the present disclosure may further have a dielectric layer formed on the third surface of the second molded substrate and a extraction conductor formed inside of the dielectric layer or on a fifth surface of the dielectric layer opposite to a sixth surface of the dielectric layer facing the third surface of the second molded substrate, the first ground electrode may have a slot overlapping the extraction conductor, and the extraction conductor may be electromagnetically coupled to the feed electrode through the slot. This allows power to be fed to the feed electrode without the through conductor. In this case, the extraction conductor may be formed on the fifth surface of the dielectric layer to constitute a microstrip line. Alternatively, a configuration may be possible, in which a second ground electrode is further provided on the fifth surface of the dielectric layer, and the extraction conductor is formed inside the dielectric layer to constitute a strip line.

The antenna device according to the present disclosure may further have a dielectric layer formed on the third surface of the second molded substrate, a second ground electrode provided on a fifth surface of the dielectric layer opposite to a sixth surface of the dielectric layer facing the third surface of the second molded substrate, and third and fourth ground electrodes formed respectively on first and second side surfaces of the dielectric layer opposite to each other and extending so as to connect between the fifth and sixth surfaces of the dielectric layer. The first ground electrode may have a slot. With this configuration, a waveguide is constituted by the first to fourth ground electrodes.

The antenna device according to the present disclosure may further have a plurality of first through conductors formed so as to be connected to the first electrode and to penetrate the first molded substrate and a plurality of second through conductors formed so as to be connected to the first ground electrode and to penetrate the second molded substrate. The first electrode may have a slot overlapping the feed electrode in a plan view, the plurality of first through conductors may be arranged along the peripheral edges of the first electrode, and the first and second molded substrates may overlap each other such that the plurality of first through conductors and the plurality of second through conductors are connected. Thus, a slot antenna can be constituted.

EXAMPLE

Example 1

A simulation model of Example 1 having the same structure as that of the antenna device 3 according to the third embodiment was assumed, and the relation between the gap G2 and antenna characteristics (reflection characteristics: S11) was simulated.

In the simulation model of Example 1, a glass material having a relative permittivity $\varepsilon$ of 3.7 and a dielectric loss tangent $\delta$ of 0.0002 was assumed as the material of the glass substrates 10 and 20. The thicknesses of the glass substrates 10 and 20 were assumed to be 24 μm and 68 μm, respectively, and the planar sizes Wx and Wy (see FIG. 7A) of each of the glass substrates 10 and 20 were both assumed to be 700 μm.

The radiation electrode 31 was assumed to have an outer diameter width a (see FIG. 7A) of 167 μm, an inner diameter width b (see FIG. 7A) of 129 μm, and a thickness of 0.26 μm. The feed electrode 32 was assumed to have a length P1 (see FIG. 7C) of 72 μm and a width Pw (see FIG. 7C) of 17.8 μm. The through conductor 33 was assumed to have a diameter of 11 μm. A distance Ps1 (see FIG. 7A) between a center point c (see FIG. 7A) of the through conductor 33 and the radiation electrode 31 in a plan view was assumed to be 12.8

μm, and a distance Ps2 (see FIG. 7A) between the center point c of the through conductor 33 and the edge of the feed electrode 32 was assumed to be 13.8 μm.

Figure 17:
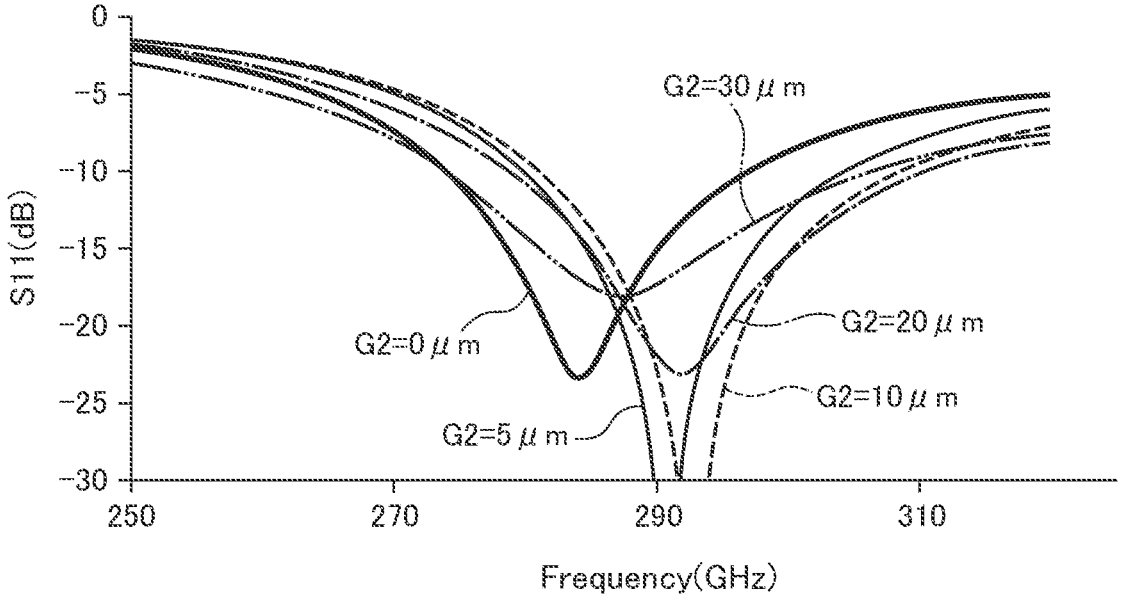
FIG. 17 is a graph illustrating a simulation result of a first Example.

The result of the simulation is illustrated in FIG. 17. As illustrated in FIG. 17, the resonance frequency is about 285 GHz when the gap G2 is absent, whereas the resonance frequency shifts to a high frequency side when the size of the gap G2 is equal to or more than 5 μm. In addition, reflection in the resonance frequency band significantly decreases when the size of the gap G2 is 5 μm or 10 μm. The result further reveals that a sufficient radiation bandwidth can be obtained even when the size of the gap G2 is 30 μm.

Comparative Example 1

Figure 18:
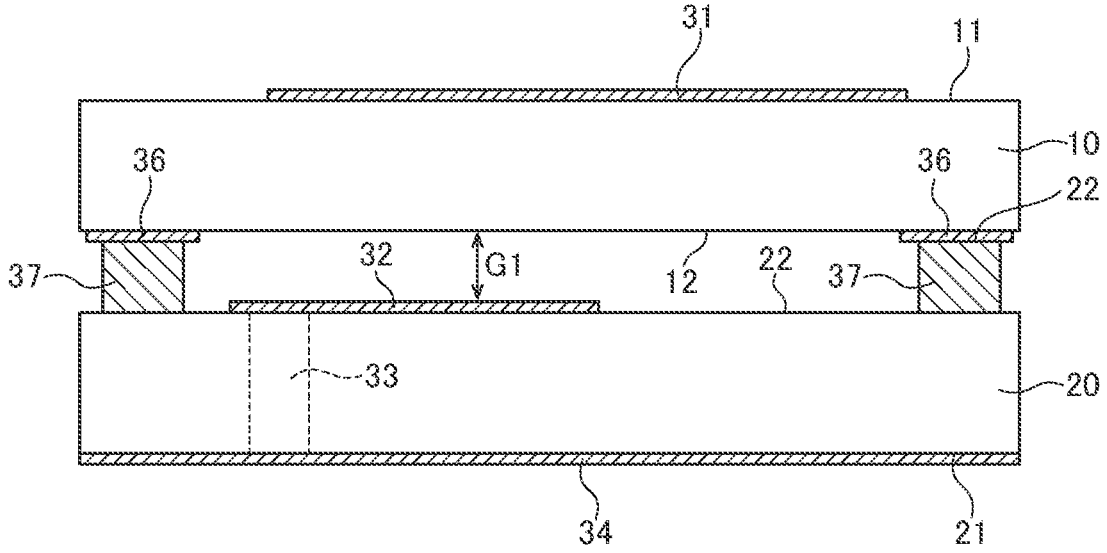
FIG. 18 is a side view for explaining the structure of a simulation model according to a first Comparative Example.

A simulation model of Comparative Example having a structure illustrated in FIG. 18 was assumed, and the relation between a gap G1 and antenna characteristics (reflection characteristics: S11) was simulated. The simulation model illustrated in FIG. 18 differs from the simulation model of Example 1 in that the feed electrode 32 is formed on the surface 22 of the glass substrate 20. Other parameters are the same as those of the simulation model of Example 1. The gap G1 is defined by the distance between the feed electrode 32 and the surface 12 of the glass substrate 10.

Figure 19:
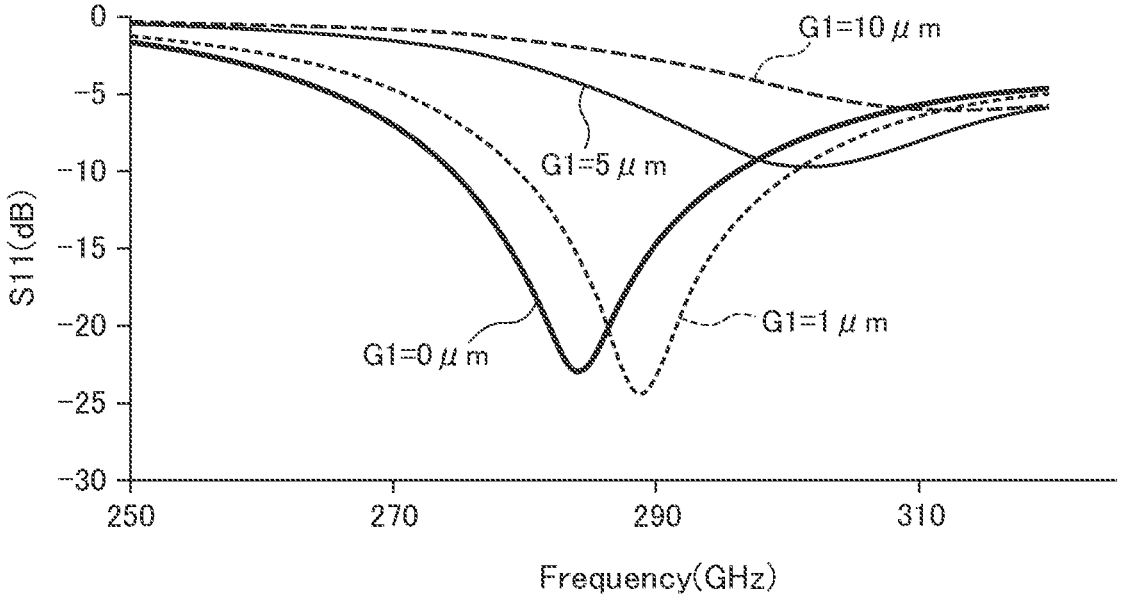
FIG. 19 is a graph for illustrated a simulation result of the first Comparative Example.

The result of the simulation is illustrated in FIG. 19. As illustrated in FIG. 19, a sufficient radiation bandwidth can be obtained when the size of the gap G1 is 1 μm, whereas the radiation bandwidth substantially disappears when the size of the gap G1 is 5 μm or 10 μm, revealing that the antenna device cannot perform its function properly. That is, it is found that antenna characteristics significantly varies with a slight variation in the size of the gap G1.

Example 2

A simulation model of Example 2 having the same structure as that of the antenna device 3 according to the third embodiment was assumed, and the relation between the gap G2 and the antenna characteristics (reflection characteristics: S11) was simulated.

In the simulation model of Example 2, molded substrates made of $Al_2O_3$ and having a relative permittivity ε of 9.2 and a dielectric loss tangent δ of 0.008 were assumed in place of the glass substrates 10 and 20. The thickness of the molded substrate corresponding to the glass substrate 10 was assumed to be 18. 2 μm, and the thickness of the molded substrate corresponding to the glass substrate 20 was assumed to be 46 μm. The planar sizes Wx and Wy of each of the molded substrates were both assumed to be 531 μm.

The radiation electrode 31 was assumed to have an outer diameter width a of 108.5 μm, an inner diameter width b of 83.5 μm, and a thickness of 0.175 μm. The feed electrode 32 was assumed to have a length P1 of 46.6 μm and a width Pw of 11.2 μm. The through conductor 33 was assumed to have a diameter of 7.2 μm. A distance Ps1 between the center point c of the through conductor 33 and the radiation electrode 31 in a plan view was assumed to be 8.3 μm, and a distance Ps2 between the center point c of the through conductor 33 and the edge of the feed electrode 32 in a plan view was assumed to be 9.0 μm.

Figure 20:
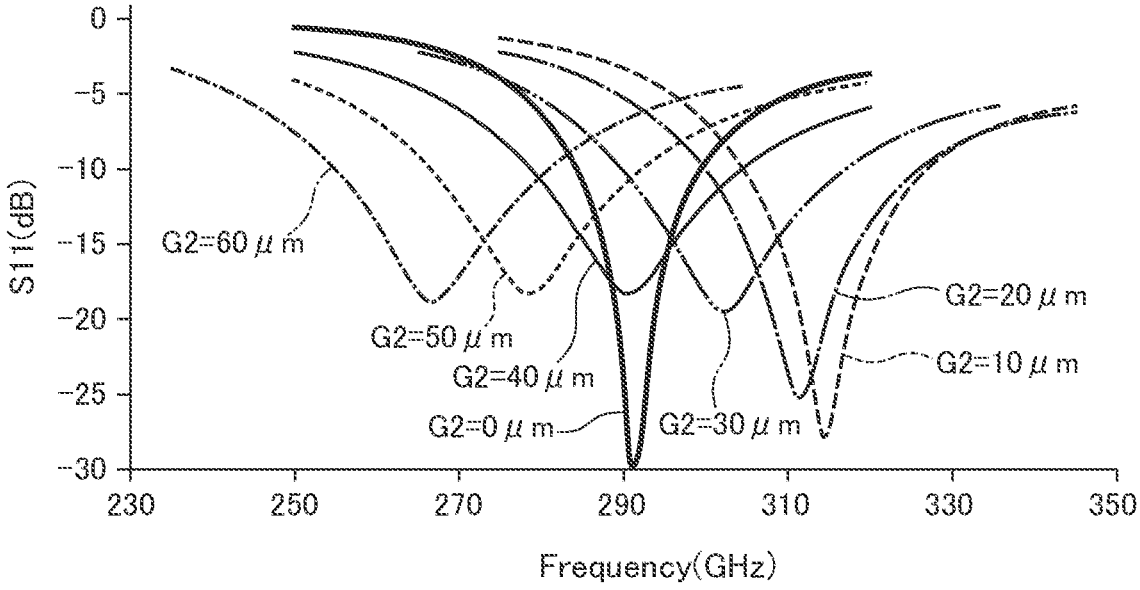
FIG. 20 is a graph illustrating a simulation result of a second Example.

The result of the simulation is illustrated in FIG. 20. As illustrated in FIG. 20, the resonance frequency is about 290 GHz when the gap G2 is absent, whereas the resonance frequency shifts to about 315 GHz when the size of the gap G2 is 10 μm. The resonance frequency shifts to a lower frequency side as the size of the gap G2 becomes larger; the resonance frequency when the size of the gap G2 is 40 μm is substantially the same as that when the size of the gap G2 is absent, and the resonance frequency when the gap G2 is more than 40 μm is lower than that when the gap G2 is absent. The result further reveals that a sufficient radiation bandwidth can be obtained even when the size of the gap G2 is 60 μm.

Comparative Example 2

A simulation model of Comparative Example having a structure illustrated in FIG. 18 was assumed, and the relation between a gap G1 and antenna characteristics (reflection characteristics: S11) was simulated. Principle parameters are the same as those of the simulation model of Example 2. That is, the molded substrate made of $Al_2O_3$ was assumed to be used in place of the glass substrate.

Figure 21:
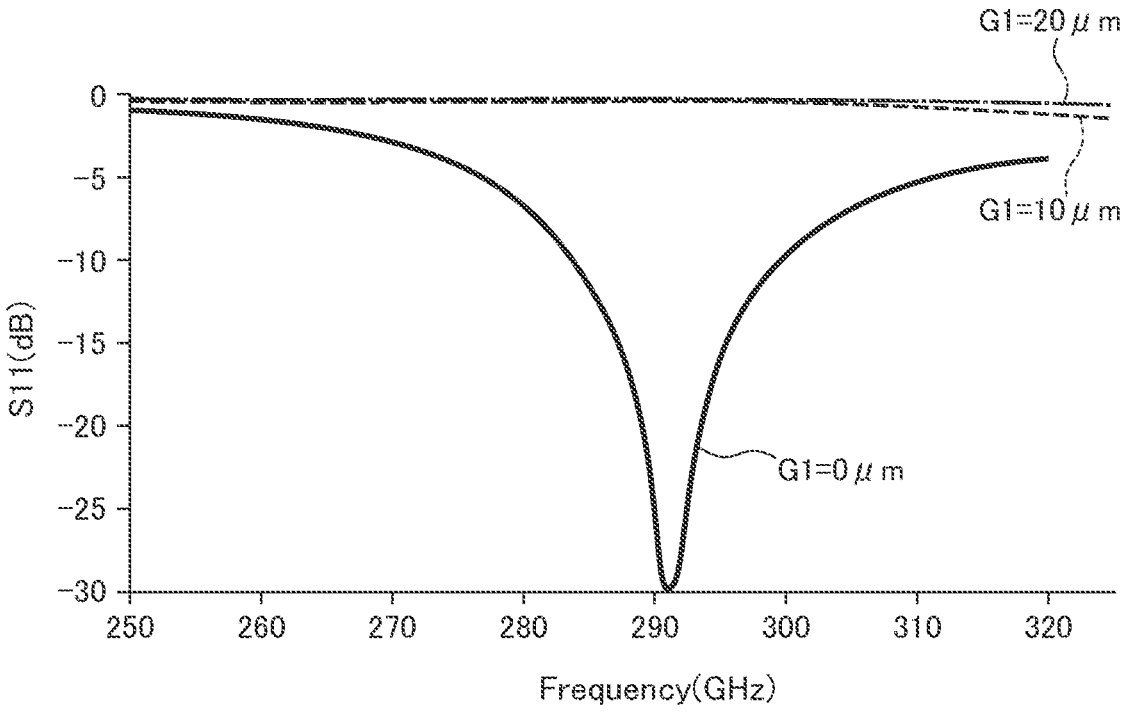
FIG. 21 is a graph illustrating a simulation result of the second Comparative Example.

The result of the simulation is illustrated in FIG. 21. As illustrated in FIG. 21, the radiation bandwidth completely disappears when the size of the gap G1 is 10 μm or 20 μm, revealing that the antenna device cannot perform its function properly.

Example 3

A simulation model of Example 3 having the same structure as that of the antenna device 4 according to the fourth embodiment was assumed, and the relation between the gap G2 and antenna characteristics (reflection characteristics: S11) was simulated. Epoxy resin having a relative permittivity of 4.4 was assumed to be used as the resin material 38. Other parameters are the same as those of the simulation model of Example 1.

Figure 22:
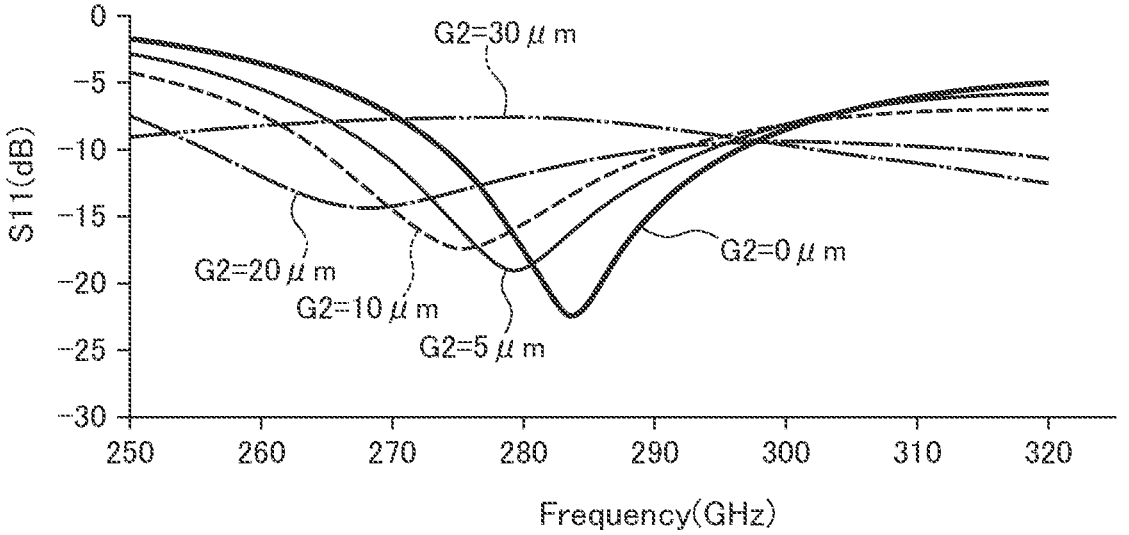
FIG. 22 is a graph illustrating a simulation result of a third Example.

The result of the simulation is illustrated in FIG. 22. As illustrated in FIG. 22, when the gap G2 is filled with the resin material 38, the resonance frequency shifts to a lower frequency side as the size of the gap G2 becomes larger. However, the radiation bandwidth completely disappears when the size of the gap G2 is 30 μm, revealing that the antenna device cannot perform its function properly.

Example 4

A simulation model of Example 4 having the same structure as that of the antenna device 4 according to the fourth embodiment was assumed, and the relation between the gap G2, the relative permittivity ε of the resin material 38, and antenna characteristics (reflection characteristics: S11) was simulated. Principle parameters are the same as those of the simulation model of Example 3.

Figure 23:
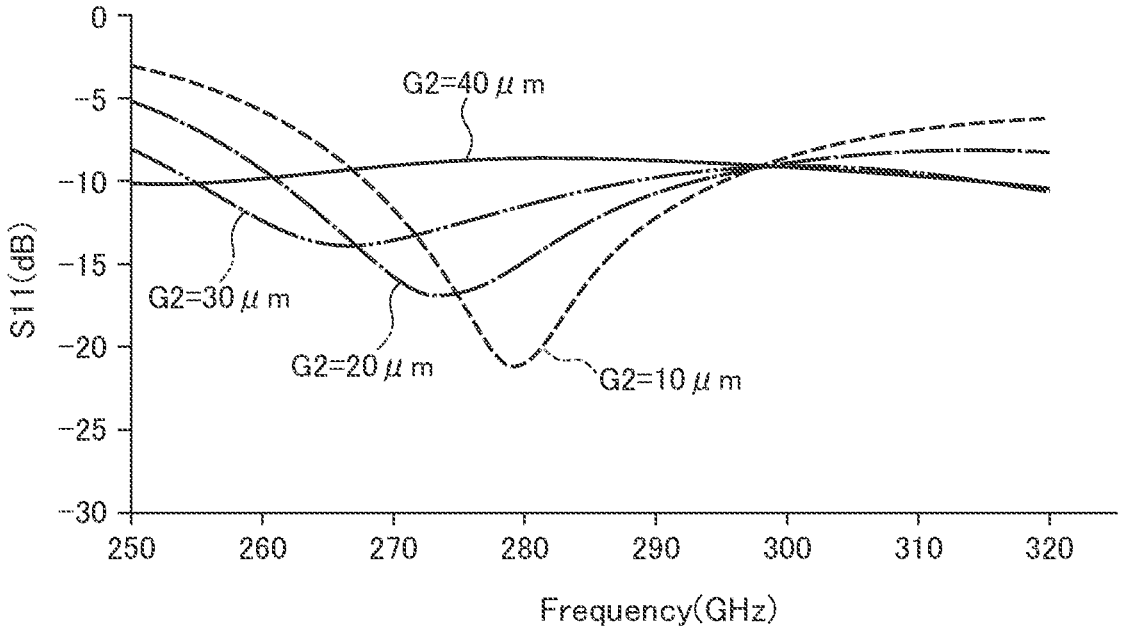
FIG. 23 is a graph illustrating a simulation result of a fourth Example when the relative permittivity ε of the resin material is 3.0.
Figure 24:
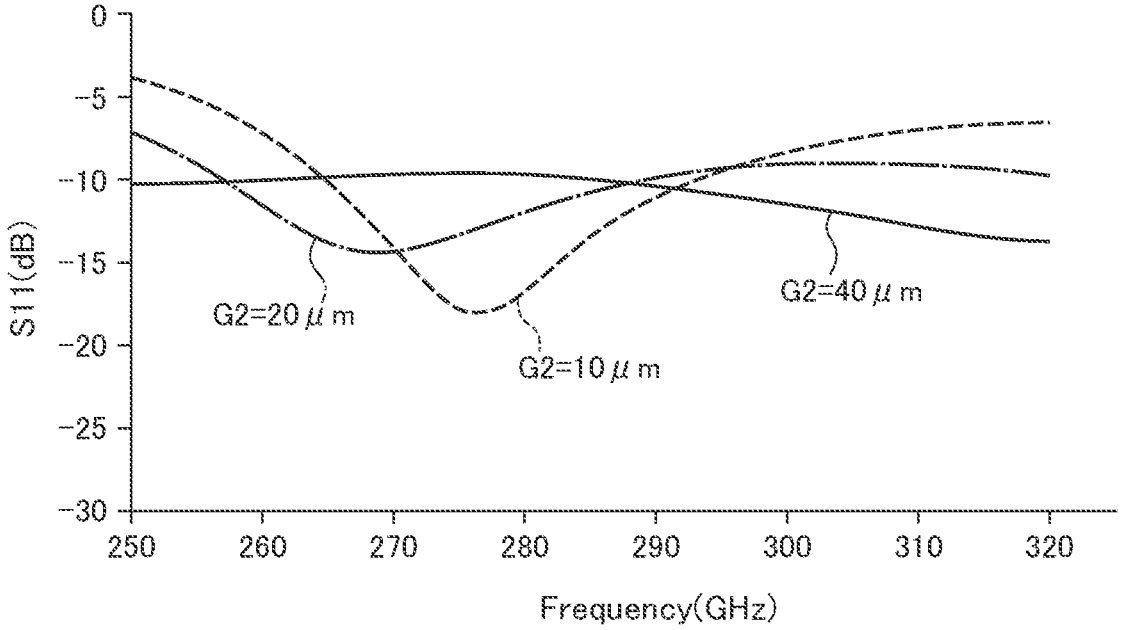
FIG. 24 is a graph illustrates a simulation result of the fourth Example when the relative permittivity ε of the resin material is 4.0.
Figure 25:
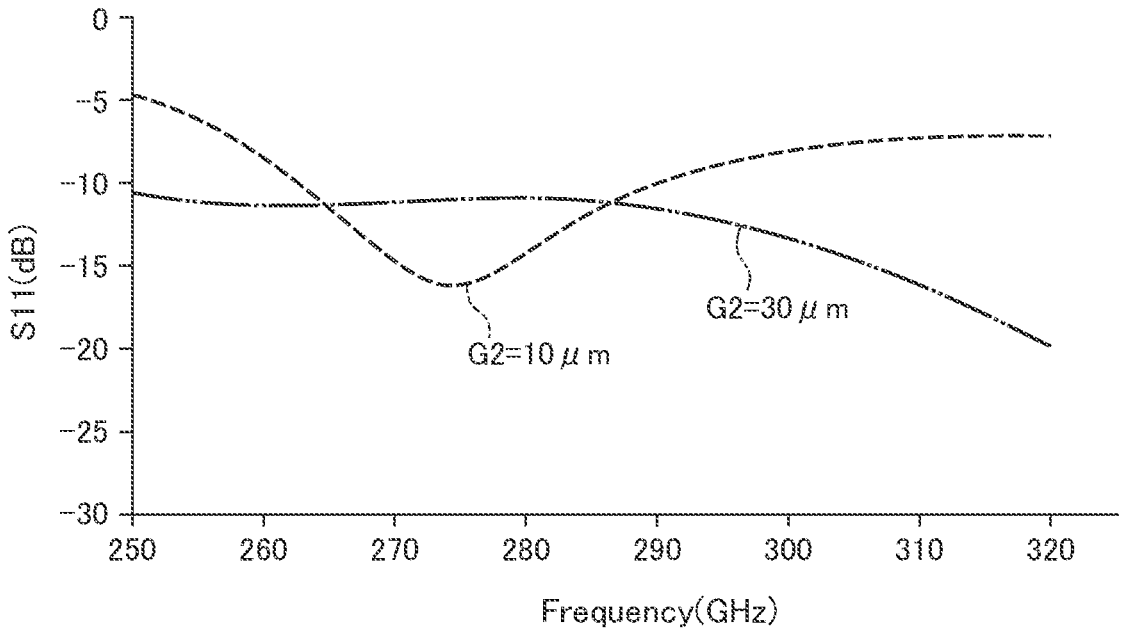
FIG. 25 is a graph illustrates a simulation result of the fourth Example when the relative permittivity ε of the resin material is 5.0.

The result of the simulation is illustrated in FIGS. 23 to 25. FIG. 23 illustrates a simulation result when the relative permittivity ε of the resin material 38 is 3.0, FIG. 25 illustrates a simulation result when the relative permittivity ε of the resin material 38 is 4.0, and FIG. 25 illustrates a simulation result when the relative permittivity ε of the resin material 38 is 5.0. When the resonance frequency f is 285 GHz (λ=1050 μm), the value of 0.06 (λ/√ε) is 36. 4 μm when ε is 3.0, 31. 5 μm when ε is 4.0, and 28.2 μm when ε is 5.0.

As illustrated in FIG. 23, in a case where the relative permittivity ε is 3.0, the radiation bandwidth appears when the size of the gap G2 is less than the value (=36. 4 μm) of 0.06 (λ/√ε), whereas the radiation bandwidth disappears when the size of the gap G2 is equal to or more than the value (=36. 4 μm) of 0.06 (λ/√ε). As illustrated in FIG. 24, in a case where the relative permittivity ε is 4.0, the radiation bandwidth appears when the size of the gap G2 is less than the value (=31.5 μm) of 0.06 (λ/√ε), whereas the radiation bandwidth disappears when the size of the gap G2 is equal to or more than the value (=31.5 μm) of 0.06 (λ/√ε). As illustrated in FIG. 25, in a case where the relative permittivity ε is 5.0, the radiation bandwidth appears when the size of the gap G2 is less than the value (=28.2 μm) of 0.06 (λ/√ε), whereas the radiation bandwidth disappears when the size of the gap G2 is equal to or more than the value (=28.2 μm) of 0.06 (λ/√ε).

What is claimed is:

1. An antenna device comprising:

a first molded substrate having first and second surfaces opposite to each other;

a second molded substrate having third and fourth surfaces opposite to each other;

a first electrode formed on the first surface of the first molded substrate;

a feed electrode formed on the second surface of the first molded substrate so as to overlap the first electrode in a plan view; and a first ground electrode formed on the third surface of the second molded substrate, wherein the first and second molded substrates overlap each other such that the second surface of the first molded substrate and the fourth surface of the second molded substrate face each other via a first gap between the second surface and the fourth surface, and wherein a height of the first gap is equal to or greater than a thickness of the feed electrode.

2. The antenna device as claimed in claim 1, further comprising a through conductor formed to penetrate the second molded substrate, wherein the first and second molded substrates overlap each other such that the through conductor and the feed electrode are connected to each other.

3. The antenna device as claimed in claim 2, further comprising a bump electrode provided at an end portion of the through conductor exposed to the fourth surface of the second molded substrate, wherein the through conductor and the feed electrode are connected to each other through the bump electrode, and wherein a second gap defined by a height dimension of the bump electrode is formed between the feed electrode and the fourth surface of the second molded substrate.

4. The antenna device as claimed in claim 3, further comprising a spacer for maintaining the first gap provided between the second surface of the first molded substrate and the fourth surface of the second molded substrate.

5. The antenna device as claimed in claim 3, wherein the first and second gaps are filled with a resin material.

6. The antenna device as claimed in claim 5, wherein assuming that a height dimension of the second gap is G2, a relative permittivity of the resin material is ε, and a wavelength of an antenna signal to be fed to the first electrode in vacuum is λ, $G2<0.06\ (\lambda/\sqrt{\varepsilon})$ is satisfied.

7. The antenna device as claimed in claim 1, further comprising:

a dielectric layer formed on the third surface of the second molded substrate; and an extraction conductor formed inside of the dielectric layer or on a fifth surface of the dielectric layer opposite to a sixth surface of the dielectric layer facing the third surface of the second molded substrate, wherein the first ground electrode has a slot overlapping the extraction conductor, and wherein the extraction conductor is electromagnetically coupled to the feed electrode through the slot.

8. The antenna device as claimed in claim 7, wherein the extraction conductor is formed on the fifth surface of the dielectric layer to constitute a microstrip line.

9. The antenna device as claimed in claim 7, further comprising a second ground electrode provided on the fifth surface of the dielectric layer, wherein the extraction conductor is formed inside the dielectric layer to constitute a strip line.

10. The antenna device as claimed in claim 1, further comprising:

a dielectric layer formed on the third surface of the second molded substrate;

a second ground electrode provided on a fifth surface of the dielectric layer opposite to a sixth surface of the dielectric layer facing the third surface of the second molded substrate; and third and fourth ground electrodes formed respectively on first and second side surfaces of the dielectric layer opposite to each other and extending so as to connect between the fifth and sixth surfaces of the dielectric layer, wherein the first ground electrode has a slot.

11. The antenna device as claimed in claim 1, further comprising:

a plurality of first through conductors formed so as to be connected to the first electrode and to penetrate the first molded substrate; and a plurality of second through conductors formed so as to be connected to the first ground electrode and to penetrate the second molded substrate, wherein the first electrode has a slot overlapping the feed electrode in a plan view, wherein the plurality of first through conductors are arranged along peripheral edges of the first electrode, and wherein the first and second molded substrates overlap each other such that the plurality of first through conductors and the plurality of second through conductors are connected.

12. The antenna device as claimed in claim 1, wherein the first and second molded substrates comprise a glass material.

13. An antenna device comprising:

a first molded substrate having first and second surfaces opposite to each other;

a second molded substrate having third and fourth surfaces opposite to each other;

a first electrode formed on the first surface of the first molded substrate;

a feed electrode formed on the second surface of the first molded substrate so as to overlap the first electrode in a plan view;

a first ground electrode formed on the third surface of the second molded substrate;

a through conductor formed to penetrate the second molded substrate; and a bump electrode provided at an end portion of the through conductor exposed to the fourth surface of the second molded substrate, wherein the first and second molded substrates overlap each other such that the second surface of the first molded substrate and the fourth surface of the second molded substrate face each other and that the through conductor and the feed electrode are connected to each other through the bump electrode, and wherein a gap defined by a height dimension of the bump electrode is formed between the feed electrode and the fourth surface of the second molded substrate.

14. The antenna device as claimed in claim 13, further comprising a spacer for maintaining the gap provided between the second surface of the first molded substrate and the fourth surface of the second molded substrate.

15. The antenna device as claimed in claim 13, wherein the gap is filled with a resin material.

16. The antenna device as claimed in claim 15, wherein assuming that a height dimension of the gap is G2, a relative permittivity of the resin material is λ, and a wavelength of an antenna signal to be fed to the first electrode in vacuum is λ, $G2<0.06\ (\lambda/\sqrt{\varepsilon})$ is satisfied.

17. An antenna device comprising:

a first molded substrate having first and second surfaces opposite to each other;

a second molded substrate having third and fourth surfaces opposite to each other;

a first electrode formed on the first surface of the first molded substrate;

a feed electrode formed on the second surface of the first molded substrate so as to overlap the first electrode in a plan view;

a first ground electrode formed on the third surface of the second molded substrate;

a dielectric layer formed on the third surface of the second molded substrate; and an extraction conductor formed inside of the dielectric layer or on a fifth surface of the dielectric layer opposite to a sixth surface of the dielectric layer facing the third surface of the second molded substrate, wherein the first and second molded substrates overlap each other such that the second surface of the first molded substrate and the fourth surface of the second molded substrate face each other, wherein the first ground electrode has a slot overlapping the extraction conductor, and wherein the extraction conductor is electromagnetically coupled to the feed electrode through the slot.

18. The antenna device as claimed in claim 17, wherein the extraction conductor is formed on the fifth surface of the dielectric layer to constitute a microstrip line.

19. The antenna device as claimed in claim 17, further comprising a second ground electrode provided on the fifth surface of the dielectric layer, wherein the extraction conductor is formed inside the dielectric layer to constitute a strip line.

20. An antenna device comprising:

a first molded substrate having first and second surfaces opposite to each other;

a second molded substrate having third and fourth surfaces opposite to each other;

a first electrode formed on the first surface of the first molded substrate;

a feed electrode formed on the second surface of the first molded substrate so as to overlap the first electrode in a plan view; and a first ground electrode formed on the third surface of the second molded substrate;

a dielectric layer formed on the third surface of the second molded substrate;

a second ground electrode provided on a fifth surface of the dielectric layer opposite to a sixth surface of the dielectric layer facing the third surface of the second molded substrate; and third and fourth ground electrodes formed respectively on first and second side surfaces of the dielectric layer opposite to each other and extending so as to connect between the fifth and sixth surfaces of the dielectric layer, wherein the first and second molded substrates overlap each other such that the second surface of the first molded substrate and the fourth surface of the second molded substrate face each other, and wherein the first ground electrode has a slot.

* * * * *